US005772197A

United States Patent [19]

Aoki et al.

[11] Patent Number: 5,772,197

[45] Date of Patent: Jun. 30, 1998

[54] SHEET POST-PROCESSING APPARATUS AND IMAGE FORMING APPARATUS USING SAME

[75] Inventors: Kazuhiro Aoki, Kawasaki; Takeshi Yamada, Tamato; Hiroaki Namiki; Minoru Kawanishi, both of Kawasaki, all of Japan

[73] Assignees: Canon Kabushiki Kaisha; Canon Aptex Kabushiki Kaisha, both of Japan

[21] Appl. No.: 919,310

[22] Filed: Aug. 28, 1997

Related U.S. Application Data

[63] Continuation of Ser. No. 693,756, Aug. 7, 1996, abandoned.

[30] Foreign Application Priority Data

Aug. 9, 1995 [JP] Japan ..... 7-203681

[51] Int. Cl.[6] ..... B65H 39/02

[52] U.S. Cl. ..... 270/58.08; 270/58.09; 270/58.14

[58] Field of Search ..... 270/58.01, 58.08, 270/58.09, 58.11–58.14, 58.19; 399/403, 407, 410

[56] References Cited

U.S. PATENT DOCUMENTS

| | | | |
|---|---|---|---|
| 5,014,091 | 5/1991 | Koike et al. | 355/321 |
| 5,382,016 | 1/1995 | Kobayashi et al. | 271/293 |
| 5,443,249 | 8/1995 | Rizzolo et al. | 270/53 |
| 5,447,298 | 9/1995 | Watanabe et al. | 270/53 |
| 5,556,251 | 9/1996 | Hiroi et al. | 270/58.19 |
| 5,580,039 | 12/1996 | Takehara et al. | 270/58.11 |
| 5,625,860 | 4/1997 | Maeda et al. | 399/403 |

FOREIGN PATENT DOCUMENTS

| | | |
|---|---|---|
| 0 346 851 A1 | 12/1989 | European Pat. Off. . |
| 0 611 063 A1 | 8/1994 | European Pat. Off. . |
| 4-257492 | 9/1992 | Japan . |

*Primary Examiner*—John T. Kwon

*Attorney, Agent, or Firm*—Fitzpatrick, Cella, Harper & Scinto

[57] ABSTRACT

A sheet post processing apparatus includes a tray for stacking a set of sheet; post processing means for post processing the set of sheets on the tray, wherein when the post processing element processes the sheets, the post processing element is moved to a predetermined position corresponding to a processing position for the set of sheets; a regulating member, movably mounted on the tray, for aligning the sheets by abutting such edges of the sheets where the sheets are processed; retracting element for retracting the regulating member to a position not obstructing movement of the post processing element, when the post processing element is moved.

11 Claims, 27 Drawing Sheets

SHEET POST-PROCESSING APPARATUS AND IMAGE FORMING APPARATUS USING SAME

This application is a continuation of application Ser. No. 08/693,756 filed Aug. 7, 1996, now abandoned.

FIELD OF THE INVENTION AND RELATED ART

The present invention relates to a post-image formation sheet processing apparatus for performing a process such as binding upon the sheets on which an image has been formed by an image forming apparatus such as a copying machine or a laser beam printer, and an image forming apparatus equipped with such a sheet processing apparatus.

A conventional post-image formation sheet processing apparatus comprises a tray on which a set of sheets are accumulated to be bound, and binding means for binding the set of sheets accumulated on the tray. When binding the sheets, the binding means is moved to an appropriate location according to the binding point or points of the set of sheets.

When binding the set of sheets, the sheets in the set must be aligned. Therefore, a regulating means is affixed to the tray, and the sheet edge on the side along which the sheets are bound are placed in contact with the regulating member to align them, and then, after the sheets are aligned by the regulating member, the binding means is moved to a predetermined binding position.

In the case of the conventional post-image formation sheet processing apparatus described above, when the binding means is moved to the binding position, the regulating member remaining in contact with the sheet set interferes with the binding means. Since the regulating member is affixed to the tray, in order to perform the binding process, the binding means is first moved to a point at which the binding means does not interfere with the regulating member, and then, it is moved to the binding position.

However, when the binding means must be moved in two directions to perform the binding process, there is a problem in that not only does the apparatus become complicated, but also the apparatus size increases, which leads to cost increase.

SUMMARY OF THE INVENTION

Accordingly, the present invention was made to solve the problem described above, and its object is to provide a post-image formation sheet processing apparatus having a simple structure and being capable of moving the post-image formation sheet processing apparatus without the interference from the regulating member, and an image forming apparatus equipped with such a post-image formation sheet processing apparatus.

According to an aspect of the present invention, there is provided a sheet post processing apparatus comprising: a tray for stacking a set of sheet; post processing means for post processing the set of sheets on the tray, wherein when the post processing means processes the sheets, the post processing means is moved to a predetermined position corresponding to a processing position for the set of sheets; a regulating member, movably mounted on the tray, for aligning the sheets by abutting such edges of the sheets where the sheets are processed; retracting means for retracting the regulating member to a position not obstructing movement of the post processing means, when the post processing means is moved.

According to another aspect of the present invention, the retracting means rotates the regulating member downward of the tray by being pushed by the positional movement of the post-image formation sheet processing apparatus.

Further, the present invention is characterized in that it is rendered applicable to an image forming apparatus comprising an image forming section, and a post-image formation sheet processing apparatus for processing the sheet on which an image is formed in the image forming section.

With the provision of the above described structure, when aligning a set of sheets, the regulating member, which is freely movable relative to the trays, aligns the set of sheets by coming in contact with the set of sheets on the side on which the set of the sheets are processed, and when moving the post-image formation sheet processing means, the retracting means, which is provided for the regulating member, retracts the regulating means to a location at which the regulating means does not interfere the positional movement of the post-image formation processing means.

As described above, the post-image formation sheet processing means can be moved with the use of the simple structure, without the interference from the regulating member. As a result, a post-image formation processing apparatus and an image forming apparatus equipped with such a processing apparatus can be simplified in structure, and therefore, can be rendered inexpensive.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Hereinafter, the preferable embodiments of the present invention will be described with reference to the drawings.

Figure 1:
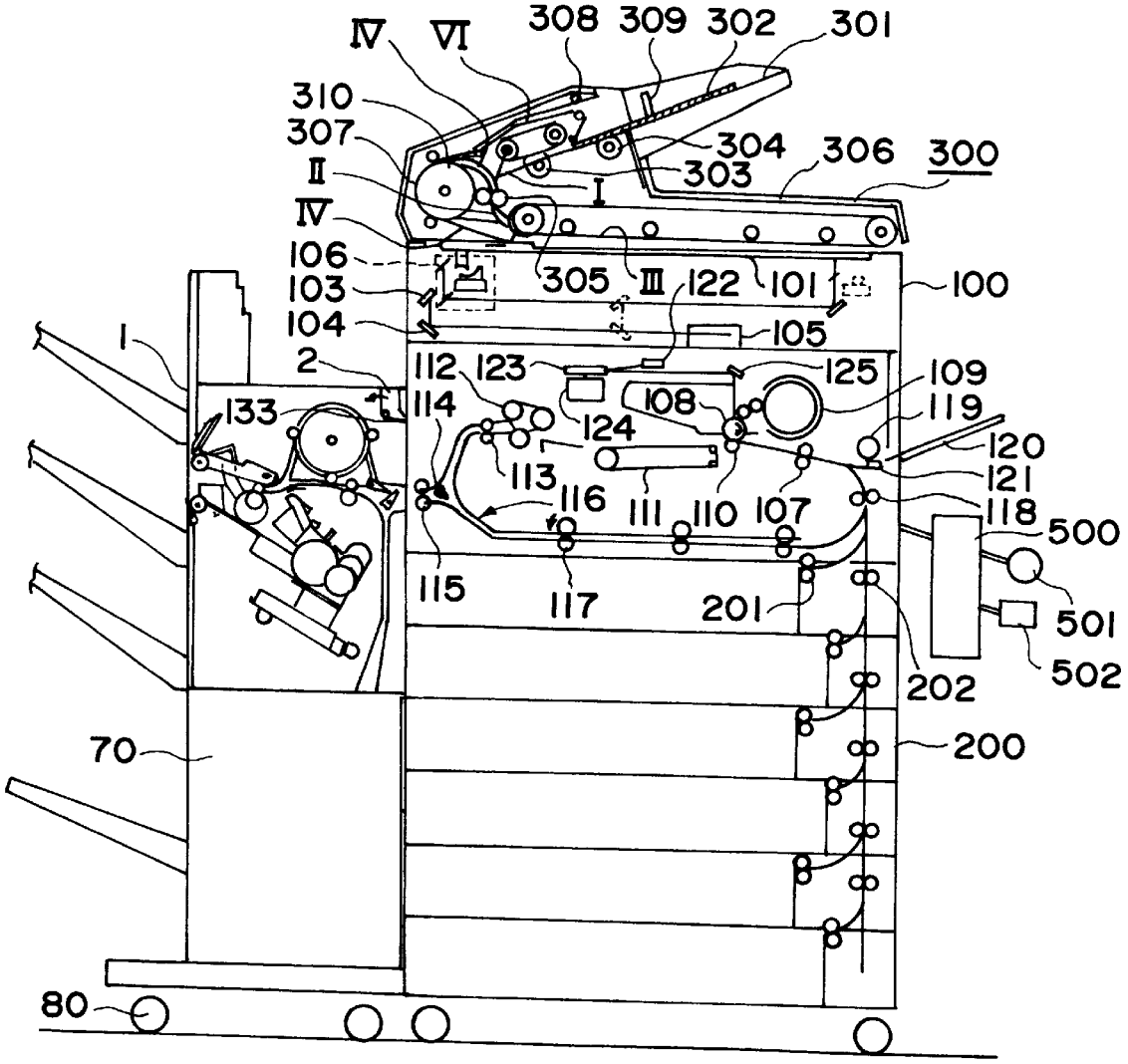
FIG. 1 is a sectional side view of a post-image formation sheet processing apparatus and a copying apparatus in accordance with the present invention.

FIG. 1 illustrates the internal structure a copying apparatus, which is an example of the image forming apparatus to which the present invention is applicable. In the drawing, a reference numeral 1 designates a post-image formation sheet processing apparatus (hereinafter, sheet processing apparatus); 100, the main assembly of a copying apparatus; 200, a cassette in which sheets of different sizes can be held; and a reference numeral 300 designates an automatic original feeding apparatus of a recirculating type, which automatically feeds an original (hereinafter, ADF).

In the copying apparatus main assembly 100, a reference numeral 101 designates an original placement glass plate; 103 and 104, an operational deflection mirror (scanning mirror) for changing the path of the light reflected from the original; 105, a focusing lens with variable magnification capability; and a reference numeral 106 designates a first scanning mirror for reading the original delivered from the ADF 300, comprising an illumination lamp and a mirror.

A reference numeral 107 designates a registration roller; 108 and 110, a photosensitive drum and a pressure roller, respectively; 111, a conveyer belt for conveying the recording sheet, on which an image has been recorded, to a fixing device; 112, a fixing device for fixing the delivered recording sheet with heat and pressure; 113 and 117, conveyer rollers for conveying the recording sheet; 114, a flapper for switching the direction in which the delivered recording sheet be conveyed; 115, a conveyer roller for conveying the recording sheet toward the sheet processing apparatus 1; 116, an overturn path for overturning the recording sheet; 118, a conveyer roller for conveying the recording sheet from the cassette 200 to a photosensitive drum unit section; 119, 120 and 121, a roller, a tray, and a separation pad, correspondingly, for conveying the recording sheet from a manual feed unit. Reference numerals 122, 123 and 125 designate a laser and a polygon mirror for forming an image on the photosensitive drum, and a mirror for changing the light path, and a reference numeral 124 designates a motor for driving the polygon mirror 123.

In the cassette 200, a reference numeral 201 designates a conveyer roller for extracting the recording sheet from the cassette 200, and a reference numeral 200 designates an intermediate roller for transferring the recording sheet extracted from the cassette 200 in the upward direction.

The surface of the photosensitive drum 108 is a seamless layer of photosensitive material. The photosensitive drum 108 is rotatively supported by the shaft thereof, and begins to be rotated in the direction of an arrow mark in the drawing, by a main motor (unillustrated) which rotates in response to the pressing of a copy start key. After the revolution and potential of the drum 108 are controlled to predetermined values (after a preliminary process is completed), the original placed on the original placement glass plate 101 is illuminated by an illumination lamp integrally formed with the first scanning mirror 106, and the light reflected by the original is projected by way of the scanning mirrors 103 and 104, and the lens 105, forming the image of the original upon a light receptor element in the lens unit.

The optical image formed on the light receptor element by the reflected light from the original is converted into electric signals, which are sent to an image processing section (unillustrated). In the image processing section, the electric signals are subjected to a predetermined data processing which is specified by the user, and then are sent to the laser section 112. The processed electric signals are converted into light by the laser section 112, and the thus generated light is deflected by the polygon mirror 123 and the mirror 125, forming an electrostatic latent image on the photosensitive drum 108. The electrostatic latent image is visualized with toner, and transferred onto the transfer sheet as will be described later.

The transfer sheet placed in the cassette 200 or the manual feed tray 120 is sent into the copying apparatus main assembly 100 by the sheet feeder rollers 118, 119, 201 and 202, and delivered to the photosensitive drum 108 by the registration roller 109, with an accurate timing so that the leading ends of the latent image and the transfer sheet meet exactly. Thereafter, the toner image on the drum 108 is transferred onto the transfer sheet as the transfer sheet passes between the photosensitive drum 108 and the roller 110.

Next, the transfer sheet is separated from the drum 108, and is led by the conveyer belt 111 to the fixing device 112, in which it is fixed with pressure and heat. Then, the transfer sheet (hereinafter, sheet) on which an image has been formed as described above is advanced toward the discharge roller 115, and is discharged into the sheet processing apparatus 1, with the printed surface facing upward.

In the ADF 300, a reference numeral 301 designates an original placement tray on which a set of originals 302 is placed. When the original is single-sided, the sheets are separated one by one starting from the bottom most sheet by a semicircular roller 304 and a separation roller 303, and the separated original is conveyed by the conveyer roller 305 and a full width belt 306, to an exposure position on the original placement glass plate 101 through paths I and II. Then, the original is stopped at the exposure position, being ready for a copying process.

After the copying process, the original is sent through a path IV to a path VI by a large conveyer roller 307, and then is returned to the original placement tray to be placed on top of the uppermost sheet of the set of originals by a discharge roller 308. A reference numeral 309 designates a recycle bar for detecting that all the originals in the set of the originals have been circulated once. More specifically, when the originals begin to be fed, the recycle bar 309 is placed on top of the set of originals, and falls due to its own weight as the originals are sequentially fed and the trailing end of the last original slips away from underneath the recycle bar 308. The single circulation of all the originals is detected by this falling of the recycle bar 309.

On the other hand, when the original is double-sided, the original is first led through the paths I and II to a path III. From the path III, the leading end of the original is led into the path IV by pivoting a path switching rotatable flapper 310, is passed through the path II, is conveyed by the full width belt 306 onto the surface of the original placement glass plate 101, and is stopped there. In other words, the original is turned over as it is sent through the paths III, IV and II in this order by the large conveyer roller 307.

At the top portion of the sheet processing apparatus, a stopper member 2 is provided. When the sheet processing apparatus 1 is connected to the copying apparatus main assembly 100, this stopper member is engaged with a hold portion 133 provided on the lateral surface of the copying apparatus main assembly 100, so that two apparatuses are accurately positioned to each other. At the bottom portion of the sheet processing apparatus 1, a sheet folder unit, or a base table 70, for supporting the main structure of the sheet processing apparatus 1 is disposed. This base table 70 is provided with casters 80, being thereby rendered movable.

Figure 2:
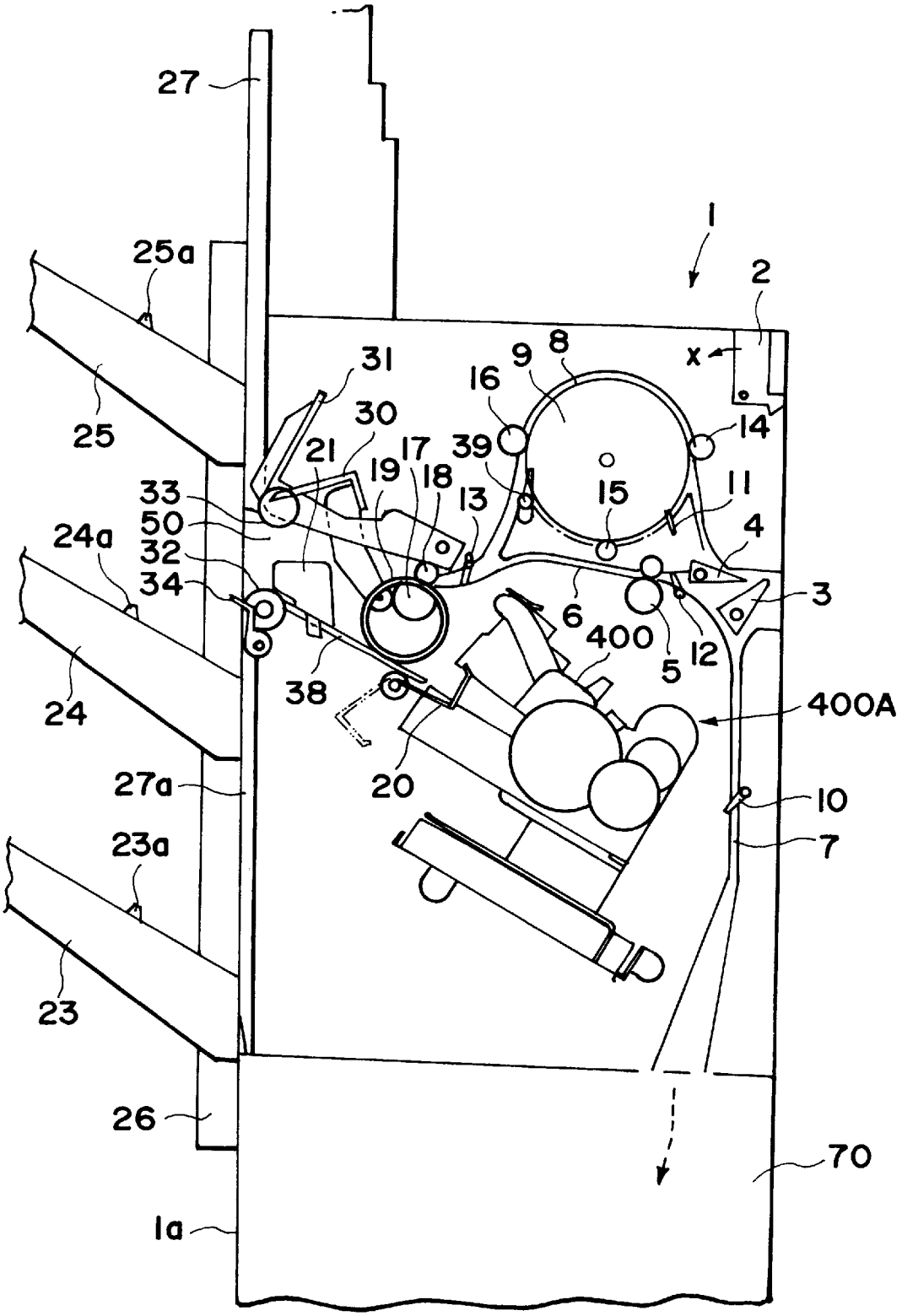
FIG. 2 is a sectional side view of the post-image formation sheet processing apparatus illustrated in FIG. 1.

Thus, when it is necessary to take care of a sheet jam which occurs adjacent to the sheet discharge portion of the copying apparatus main assembly 100, or in the sheet transfer portion between the sheet processing apparatus 1 and the copying machine main assembly 100, at first, the engagement between the stopper member 2 and the hold portion 133 is broken by rotating the stopper member 2 in the X direction in FIG. 2, and then, the sheet processing apparatus 1 is horizontally moved to create some room between the sheet processing apparatus 1 and the copying apparatus main assembly 100, so that the paper jam can be easily handled.

When the sheet discharged from the sheet discharge portion of the copying apparatus main assembly 100 is to be processed in the sheet processing apparatus 101, the upstream side of the flapper 3 is flapped to the down position in FIG. 2, and the upstream side of the flapper 4 is flapped to the up position in FIG. 2, so that the discharged sheet is sent into the first path 6 by way of a roller pair 5. When the discharge sheet is to be conveyed to the folding apparatus, the upstream side of the flapper 3 is flapped to the up position, so that the sheet is sent in the direction indicated by an broken line arrow through the third path 7. At this time, only the case in which the sheet is processed in the sheet processing apparatus 1 will be described.

The sheet discharged from the discharging portion of the copying apparatus main assembly 100 is sent downstream through the first path 6 by way of the roller pair 5, with the upstream end portion of the sheet being positioned on the downstream side. In the same drawing, a reference numeral 8 designates a second path (buffer path); 9, a buffer roller; 14, 15 and 16, buffer rollers; and reference numerals 10, 11, 12 and 13 designate sheet sensors which detect passing sheets, remaining sheets, or the like. A reference numeral 17 designates a first discharge roller; 18, a pressing roller; and a reference numeral 19 designates a discharge alignment belt, which is pinched between the first discharge roller 17 and the pressing roller 18, being rotated by the discharge roller since an unillustrated endless rib, provided on the inward facing surface of the belt 19 to prevent the belt from slipping off from the rollers, is engaged with the first discharge roller 17.

A reference numeral 21 designates a lateral jogging plate, which aligns the sheets in coordination with a trailing end regulating member 20, that is, a regulating member which will be described later, when the sheets are subjected to the post-image formation sheet processing operation such as stapling. Reference numerals 23, 24 and 25 designate the first, second, and third trays, and a reference numeral 26 designates a tray unit, which holds the first, second and third trays 23, 24 and 25. The tray unit 26 is enabled to vertically travel by a driving power source enclosed in the bottom portion of the tray unit 26.

A reference numeral 400A designates a stapler unit equipped with an electric stapler 400, a sheet processing means for stapling a set of sheets accumulated on the stapling tray 38 which is a sheet processing tray. The stapler unit 400A is rendered movable in the direction of an arrow mark Y in FIG. 3 by a pulse motor which will be described later, so that the sheets accumulated on the stapling tray 38 can be stapled on various points: single front point (stapling point H1), two points (stapling points H2 and H3, and sing rear point (stapling point H4). Incidentally, the drawing illustrates an A3 sheet, A4 sheet, B4 sheet and B5 sheet as the sheets to be stapled, but according to the gist of the present invention, the sheet size is not limited to specific sheet sizes in this embodiment.

Figure 4:
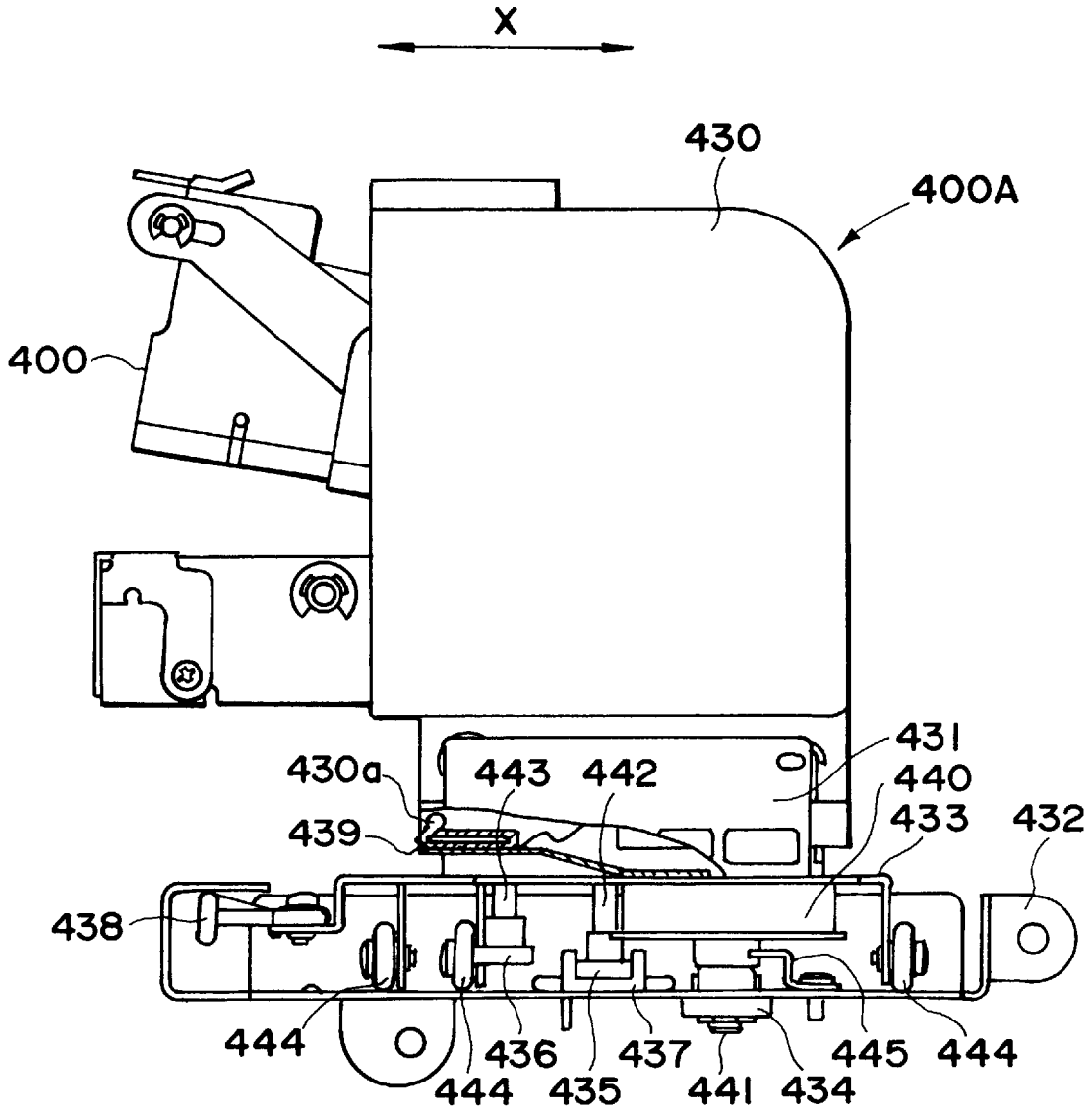
FIG. 4 is a sectional side view of the stapler unit.

Referring to FIG. 4, the electric stapler 400 is affixed to a stapler cover 430, being enabled to move in the X direction by a supporting member 431 affixed to a movable table 433. Further, a spring member 439 is affixed to the movable table 433, and the spring member 349 applies upward pressure to the stapler cover 430, positioning the stapler cover against the stopper 430*a*.

Further, supporting shafts 441, 442 and 443 are affixed to the movable table 433. A pulley gear 440, guiding-supporting members 434, 435 and 436 are rotatively attached to the correspondent shafts. Rollers 444 are rotatively supported by the movable table 433 to enable the movable table 433 to be moved in parallel to the sheet edge. Also, a stopper regulating member 438 constituting the means for retracting the trailing end regulating member 20 is affixed to the movable table 433. The trailing end regulating member 20 will be described later.

Figure 5:
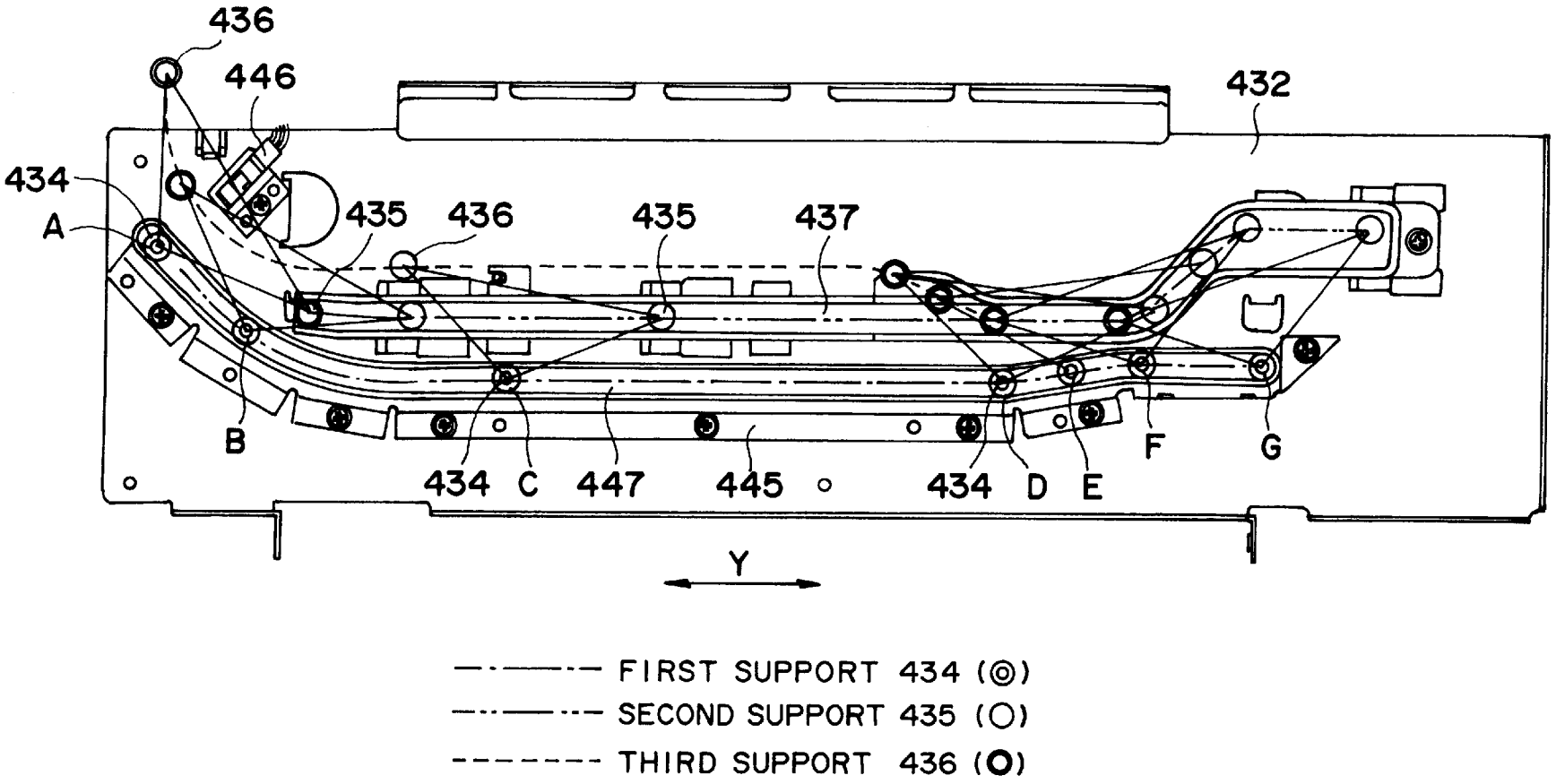
FIG. 5 is a schematic plan view depicting the moving path of the stapler unit.

Further, referring to FIG. 5, a stay 432 is provided with a groove 447, in the form of an elongated hole, for regulating the movement of the first guiding-supporting member 434. Also, a rail 437 which regulates the movements of the second and third guiding-supporting members 435 and 436, and a rack gear 445 which meshes with a pulley gear 440, are affixed to the stay 432.

Incidentally, in the same drawing, a reference numeral 446 designates a photointerrupter for detecting whether or not the stapler unit 400A is at the home position (in the drawing, whether or not the first guiding-supporting member 434 is at a point indicated by A). In this embodiment, the photointerrupter 446 is used to control the stapling point or points of the stapler unit 400A by regulating the rotational distance which a pulse motor rotates from the home position. The amount of the pulse motor rotation is controlled by regulating the number of pulses. The detailed description of the pulse motor will be given later. According to the gist of the present invention, the means for controlling the stapling points of the stapler unit 400A is not limited to the structure described above.

Figure 6:
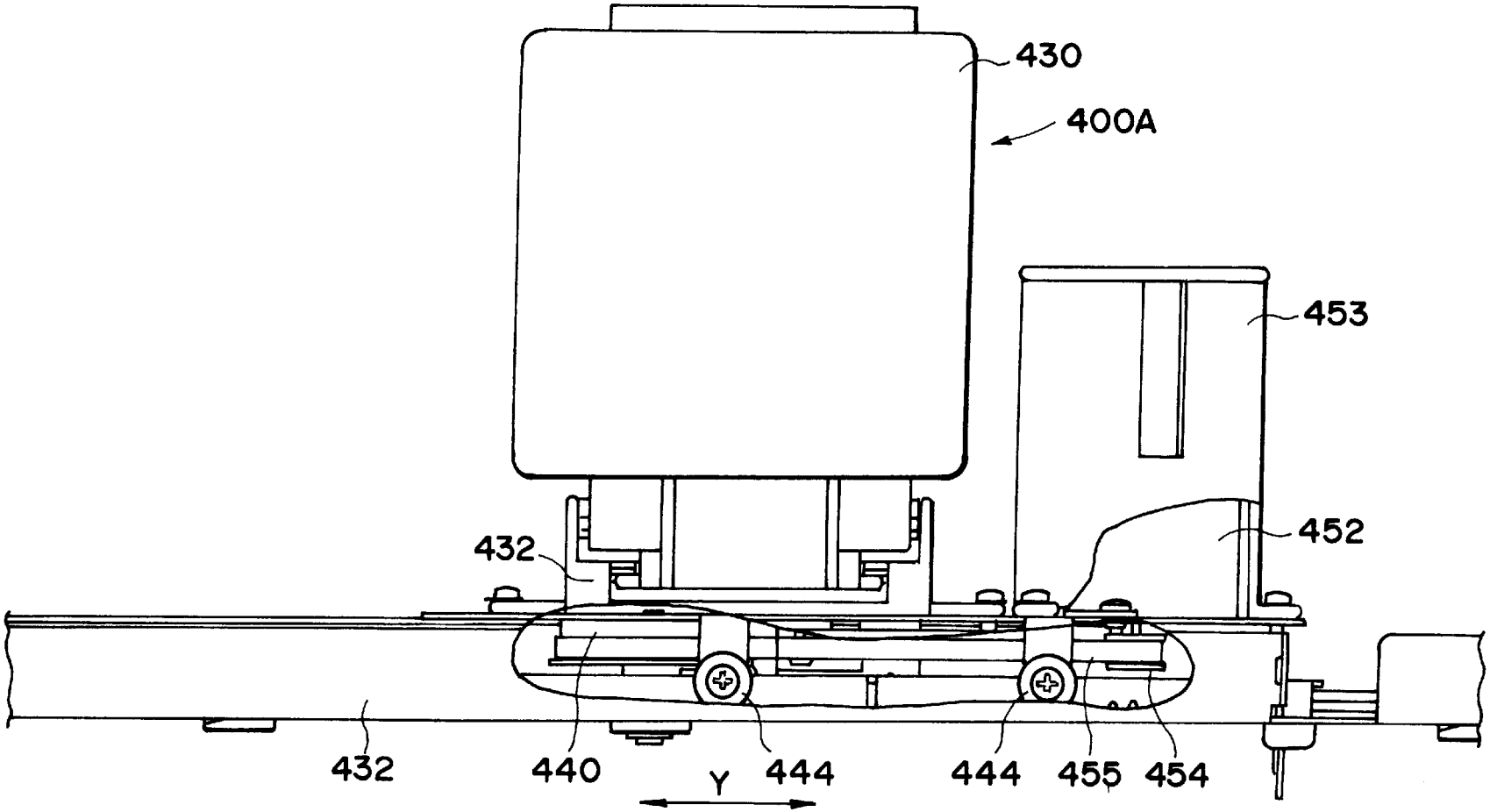
FIG. 6 is a schematic side view of the right-hand portion of the stapler unit.

Referring to FIG. 6, a pulse motor 452 for moving the stapler unit 400A in the arrow mark Y direction is affixed to the movable table 433. A belt pulley 454 is affixed to the pulse motor 452. The belt pulley 454 is connected to a pulley gear 440 by way of a timing belt 455. The rotation of the motor 452 is transmitted to the pulley gear 440 by way of the belt pulley 454 and the timing belt 455, whereby the stapler unit 400A is moved in the arrow mark Y direction. A reference numeral 453 designates a cover for the electrical component such as the motor 452.

When the stapler unit 400A is moved, the first guiding-supporting member 434 travels between points A and G along the groove 447 in the form of an elongated hole of the stay 432, and the second guiding-supporting member 435 moves along the straight portion of the rail 437 only when the first guiding-supporting member 434 is traveling between the points A and E, whereas the third guiding-supporting member 436 moves along the straight portion of the rail 437 only when the first guiding-supporting member 344 is traveling between the points E and G.

For example, referring to FIG. 5, when the first supporting member 434 is at the point A, the movement of the second guiding-supporting member 435 is regulated by the rail 437, whereas the third guiding-supporting member 436 is free to move. In this condition, the sheets can be stapled at an angle on the point H1 in FIG. 3. When the first guiding-supporting member 434 is moved from the point A to the point C, the stapler unit 400A having been angled by a predetermined amount at the point A is gradually rotated to become parallel to the width direction of the sheet as the second guiding-supporting 435 moves along the rail 437. Further, as the first guiding-supporting member 434 moves between the points C and D, the movement of the stapler unit 400A is regulated so that it remains parallel to the width direction of the sheet. With the provision of the above structure, sheets of various sizes can be stapled on two points (H2 and H3) along the sheet edge.

As described above, although the stapler unit 400A is allowed to move freely in the Y direction, the position and angle of the stapler unit 400A are always regulated by two of the three guiding-supporting members 434, 435 and 436; therefore, it is possible to staple sheets of various sizes at the single front point, or the two points along the leading edge. Incidentally, the distance the first guiding-supporting member 434 travels is regulated by the amount of the pulse motor rotation as described before.

Figure 3:
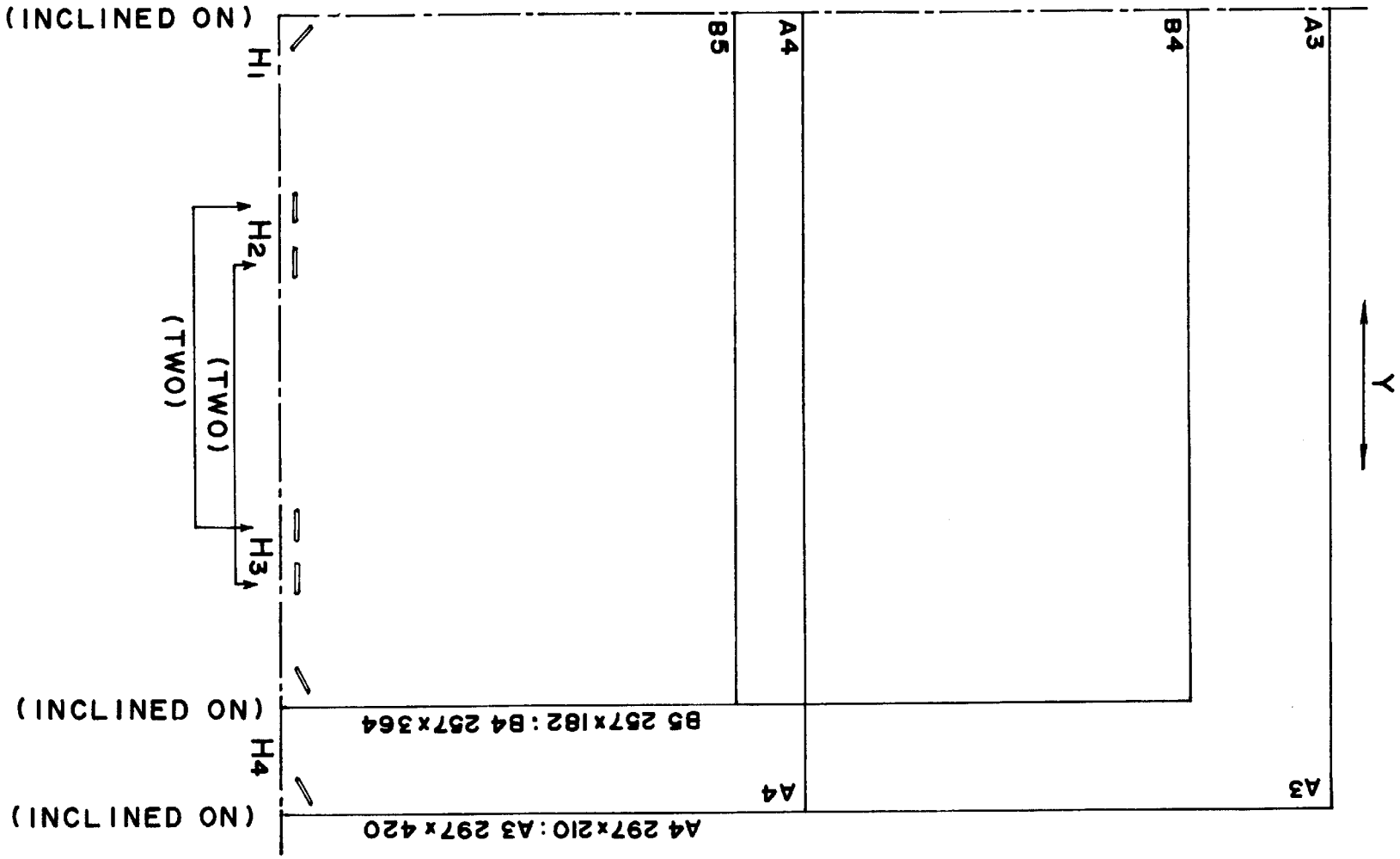
FIG. 3 is a schematic drawing showing the points on the sheet, at which the sheets are bound by the stapler unit of the post-image formation sheet processing apparatus.

Referring to FIG. 3, in this embodiment, a sheet alignment reference is provided on one side so that the point H1 for the single front stapling is shared by the sheets of various sizes. However, the sheet alignment reference may be placed to align with the sheet center so that the point H2 for two points stapling can be shared by the sheets of various sizes. Such an arrangement does not contradict the gist of the present invention.

In order to bind the sheets in the above described manner, it is necessary to provide a regulating member which aligns the set of sheets accumulated on the stapling tray 38, by coming in contact with the sheet edge on the side to be stapled, that is, the trailing end side of the sheet edge in this embodiment. Therefore, the trailing end regulating member 20 is provided at the trailing end side of the stapling tray 38.

Figure 7:
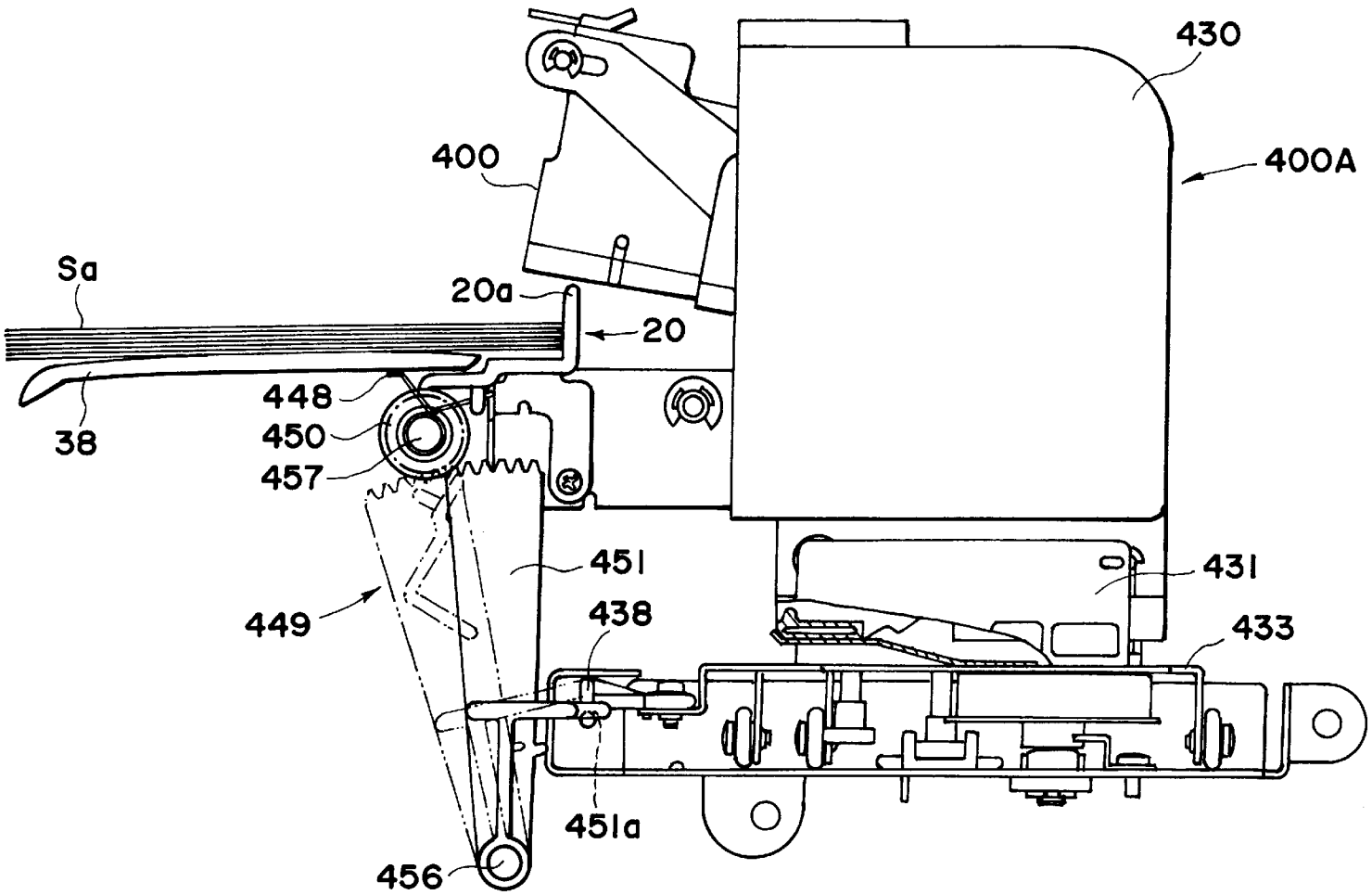
FIG. 7 is a schematic drawing depicting the retracting movement of the stapler unit.

Referring to FIG. 7, the trailing end regulating member 20 is rotatively supported on a shaft member 457 affixed to the stapling tray 38, and also is pressured in the counterclockwise direction by a spring member 448 wound around the shaft member 457, so that a regulating portion 20*a* formed at one end of the trailing end regulating member 20 projects upward from the trailing end of the stapling tray 38. With the regulating portion 20*a* projecting upward, the trailing ends of the sheets accumulated on the stapling tray 38 come in contact with the trailing end regulating member 20, and therefore, a sheet set Sa is aligned on the trailing edge side.

Since the trailing end regulating member 20 and the electric stapler are positioned to overlap with each other, the trailing end regulating member 20 interferes with the positional movement and stapling action of the stapler unit 400A. Therefore, the trailing end regulating member 20 is provided with a retracting means 449 for retracting the trailing end regulating member 20 to a position at which the trailing end regulating member 20 does not interfere with the movement of the stapler unit 400A.

The retracting member 449 comprises a gear portion 450 which is solidly affixed to the trailing end regulating member 20, and also is attached to the shaft member 457; a rotatable sector gear 451 which is pivoted at the bottom end portion, and meshes with the gear portion 450 of the trailing end regulating member 20; and a stopper regulating member 438 which is solidly affixed to the movable table 433, and rotates the sector gear 451 about a pivot 346 by coming in contact with the sector gear 451, when the stapler unit 400A is moved.

Figure 8:
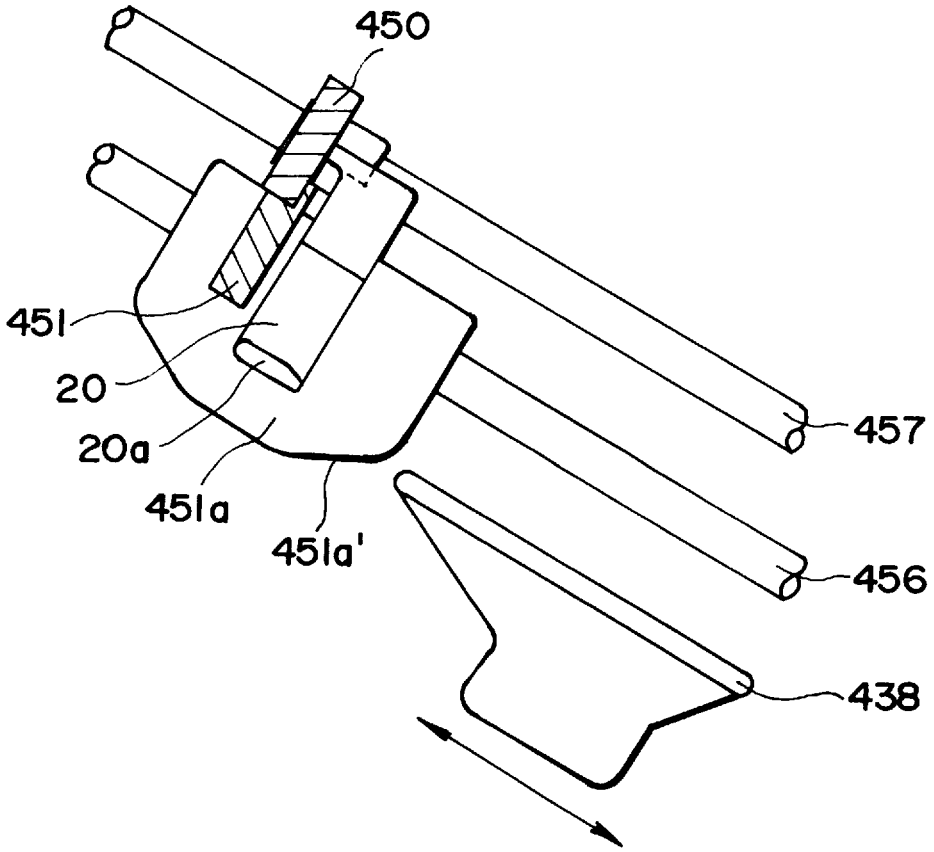
FIG. 8 is a schematic plan view depicting the way a stopper regulating member presses a sector gear as the stapler unit moves.

Referring to FIG. 8, the sector gear 451 is provided with a contact portion 451*a* having a partially cutaway end portion. When the stapler unit 400A is moved, the stopper regulating member 438 makes contact with the cutaway portion 451*a'* of the contact portion 451*a*. As the stopper regulating member 438 makes contact with the cutaway portion 451*a,'* the sector gear 451 is pushed in the direction perpendicular to the moving direction of the stapler unit 400A, being rotated to the position contoured by a broken line in FIG. 7.

As the sector gear 451 rotates, the gear portion 450 meshed with the sector gear 451 rotates, whereby the trailing end regulating member 20 is rotated about the shaft member 457, winding up the spring member 448, downward to the retracting position below the stapling tray 38, at which the trailing end regulating member 20 does not interfere with the movement of the stapler unit 400A.

As the stapler unit 400A is moved further, the stopper regulating member 438 becomes disengaged from the contact portion 451*a* of the sector gear 451. Consequently, the resiliency of the spring member 448 rotates the trailing end regulating member 20 back to the position at which the trailing end regulating member 20 regulates the trailing end edge of the sheet set Sa illustrated in FIG. 7, and at the same time, the sector gear 451 is also rotated back to the home position, by the resiliency of the spring member 448.

Figure 9:
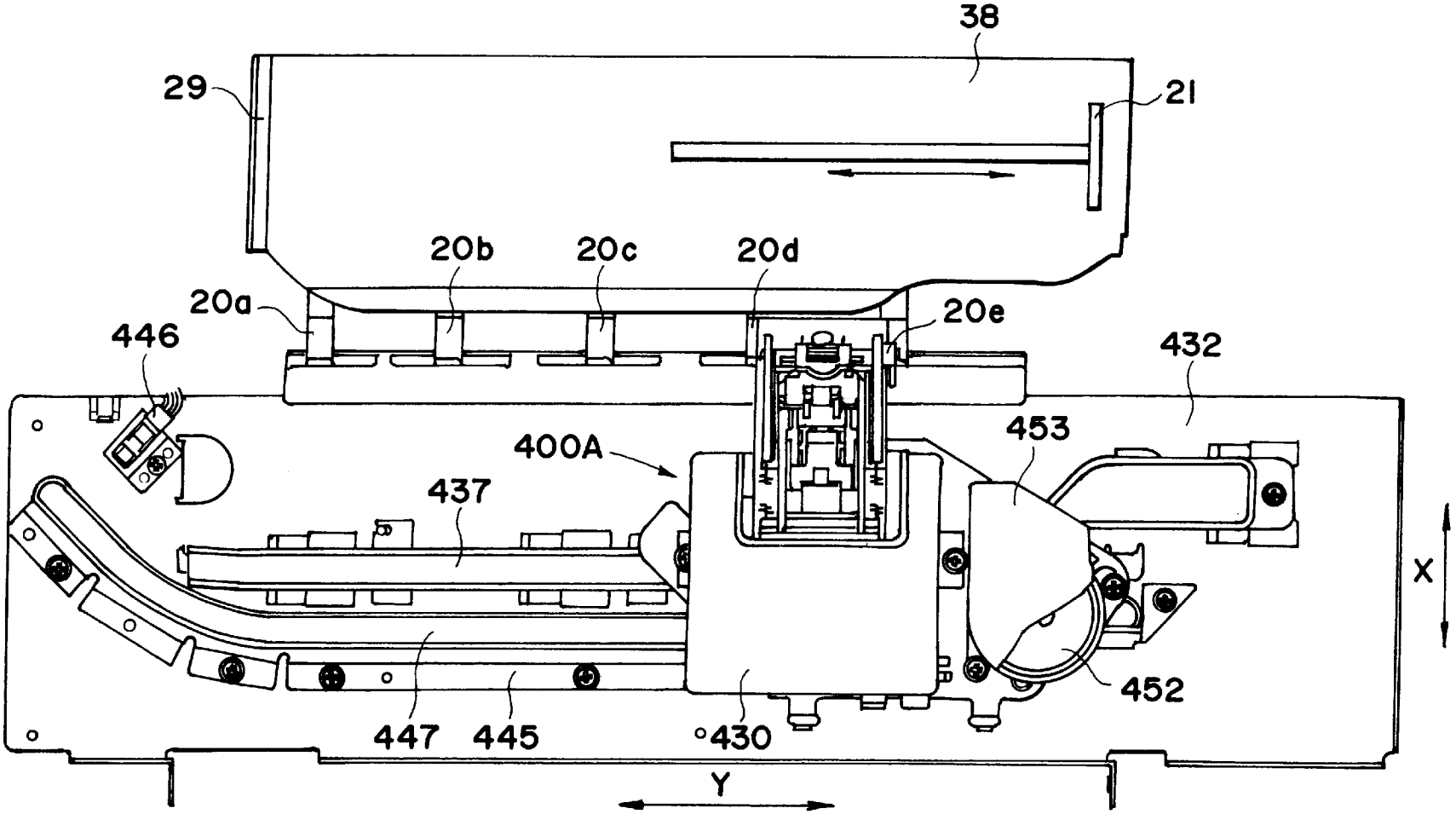
FIG. 9 is a schematic drawing depicting the movement of the stapler unit, as well as the movement of a trailing end regulating member.

Referring to FIG. 9, there are a plural number of the trailing end regulating member 20 arranged in the width direction of the sheet. Each of these terms 20*a,* 20*b,* 20*c,* 20*d* and 20*e* is provided with the retracting means, so that they can be independently rotated.

In FIG. 9, the three trailing end regulating members 20*a,* 20*b* and 20*c* are disposed to align the trailing end of the sheet set in response to the location of the stapler unit 400A. The other two trailing end regulating members 20*d* and 20*e* are disposed not to interfere with the movement of the stapler unit 400A.

Figure 10:
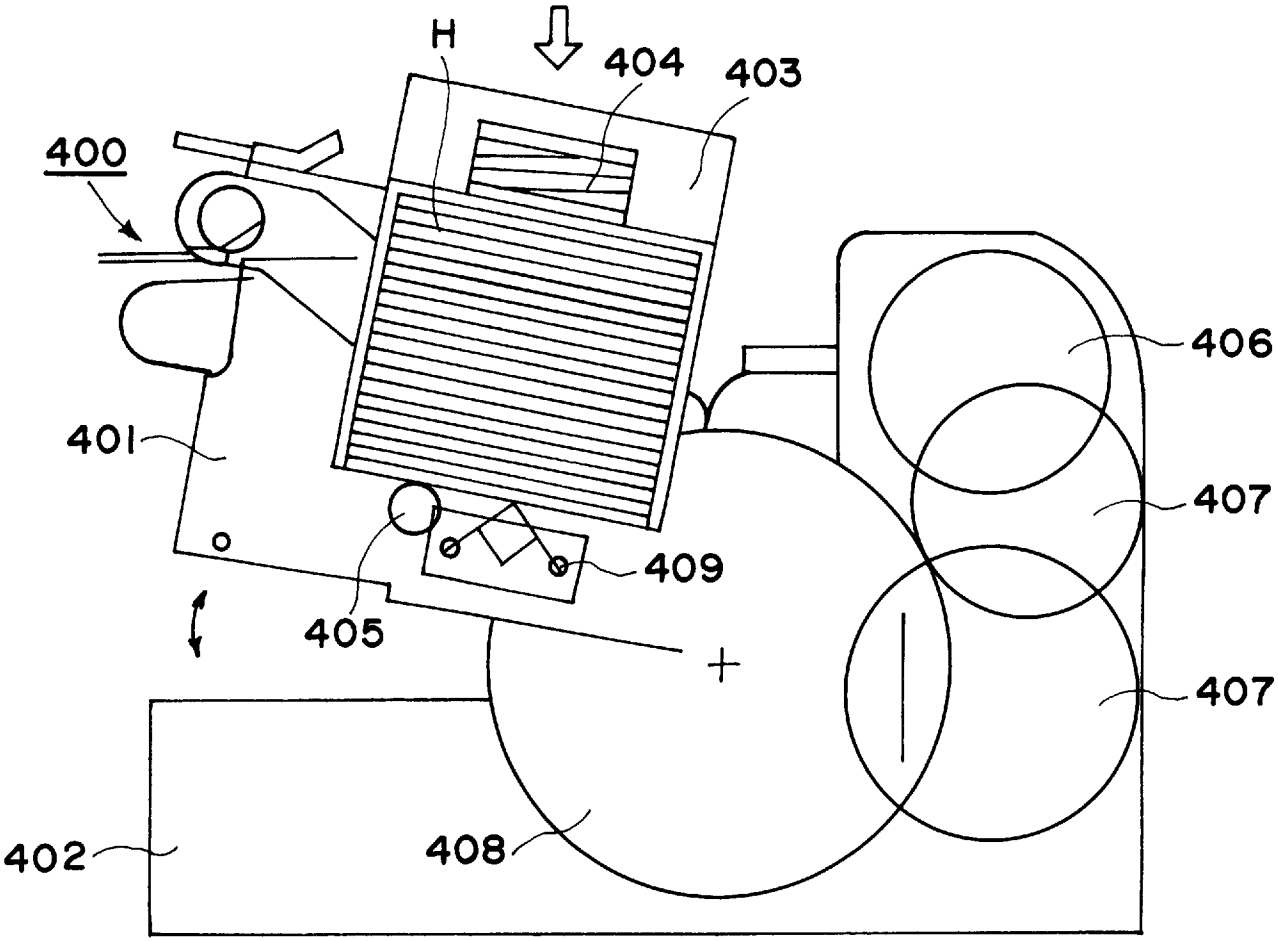
FIG. 10 is a schematic drawing depicting the structure of the electric stapler of the stapler unit.

Next, the specific structure and basic operation of the electric stapler 400 will be described. Referring to FIG. 10, the electric stapler 400 is shaped like an alligator mouth, comprising a forming portion 401, the top piece, and a stapling table 402 (anvil portion), the bottom piece. The forming portion 401 (head portion) removably contains a staple cartridge 403, and the staple cartridge 403 is loaded with approximately 5,000 staples H laid together in the form of a plate.

The plate of staples H loaded in the staple cartridge 403 is kept under downward pressure by a spring 404 provided at the topmost side of the staple cartridge 403, so that a staple feeding force is applied to a staple feeding roller 405. The staple H fed by the feeding roller 405 is formed one by one into a U-shape by oscillating the forming portion 401.

As the stapler motor 406 is activated, an eccentric cam gear 408 is rotated by the driving force transmitted from the stapler motor 406 by way of a gear train 407. Then, an eccentric cam integral with the eccentric cam gear 408 functions to oscillate the forming portion 401 toward the stapling table as indicated by an arrow mark; the electric stapler 400 clinches the staple.

The electric stapler 400 comprises a reflection type sensor 409 for detecting the absence of the staple H in the staple cartridge 403. It is disposed at the bottom portion of the staple cartridge 403. In this embodiment, staple jam which occurs when the staple H is fed out of the staple cartridge 403 is also detected by the reflection type sensor 409.

Figure 11:
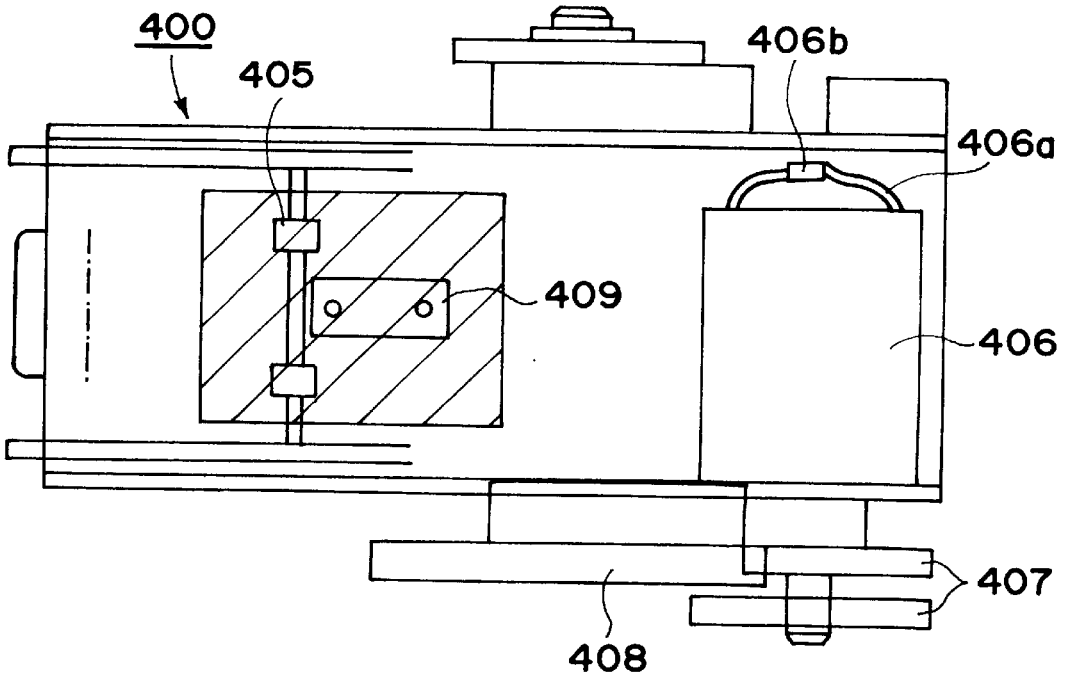
FIG. 11 is a plan view of the electric stapler.

Next, the staple jam detection will be described. FIG. 11 is a plan view of the electric stapler 400. The stapler motor 406 is connected to an electric cord 406*a,* through which driving current flows. This electric cord 406*a* comprises a current sensor 406*b* (anomaly detecting means) as a load detecting means for detecting the value of the current flowing through the electric cord 406*a*.

Figure 12:
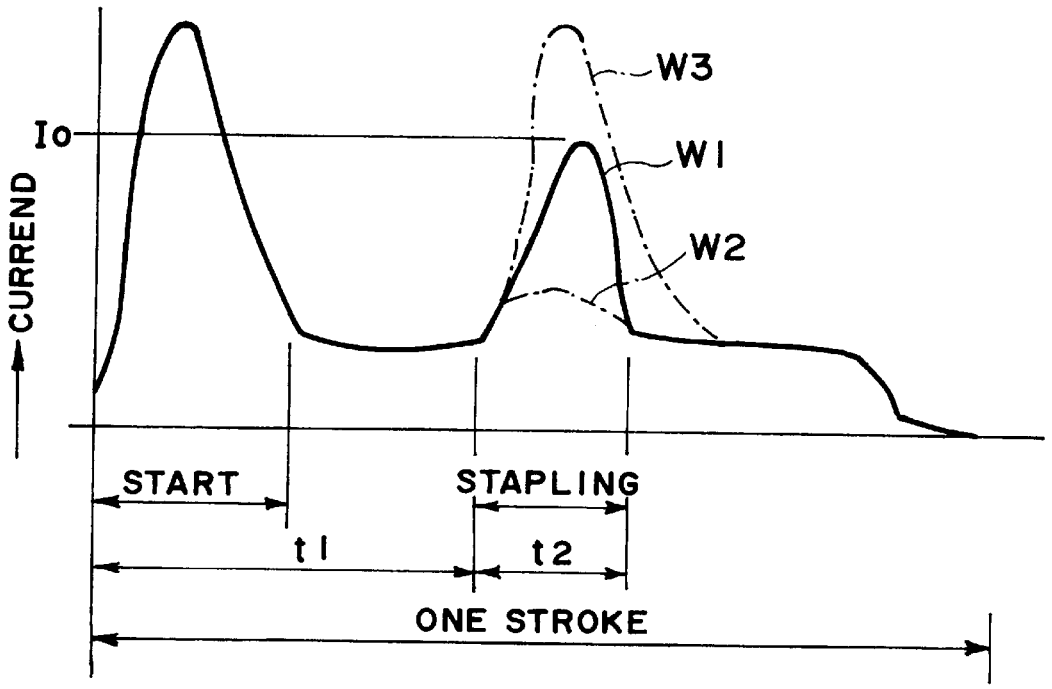
FIG. 12 is a graph showing the value of the current which flows through a stapler motor during the stapling action of the electric stapler.

FIG. 12 is a graph showing, in the form of waves, the values of the current flowing through the stapler motor 406 during a single stapling cycle. These values were detected by the current sensor 406*b*. In the same drawing, an alphanumerical reference W1 designates a waveform at the moment a staple H normally came out, penetrated the sheet set S, and was clinched, and W2 designates a waveform obtained in the case of blank stapling (stapler went through a stapling motion, but staple H did not come out). During blank stapling, there is little load which otherwise will be generated as the staple H penetrates the sheet set S, or is clinched; therefore, the current value level drops.

An alphanumerical W3 designates a waveform obtained when a staple penetration failure or a staple jam occurred. During such an occurrence, normally, an excessive load is generated, which causes the current value to increase to an extreme level. Therefore, when the current level is around a value I0 (initial value), it can be determined that stapling is being normally carried out, whereas when I>I0+C (C:dispersion), it is suggested that mechanical anomaly such as the staple jam or the staple penetration failure is occurring, and when I<I0−C, it can be determined that a blank stapling is occurring. The out-of-staple condition, or the staple jam condition, which has occurred to the electric stapler 400, can be conveyed to an operator by a display portion employing LED's or the like.

Next, the stapling operation of the electric stapler 400 with the above structure will be described.

A plate of staples H loaded in the staple cartridge 403 are fed out one by one from the bottom side by the feeder roller 405; the staple H1 at the leading end of the plate is sent to a staple bending block 415 which holds the center portion of the staple H1 in a holding groove 415*a*.

Figure 13:
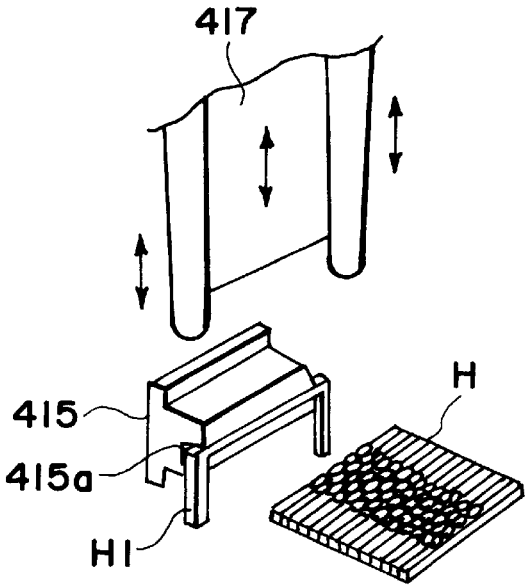
FIG. 13 is a perspective view depicting the way the center portion of the staple at the leading end is held in the holding groove of a staple bending block.
Figure 14:
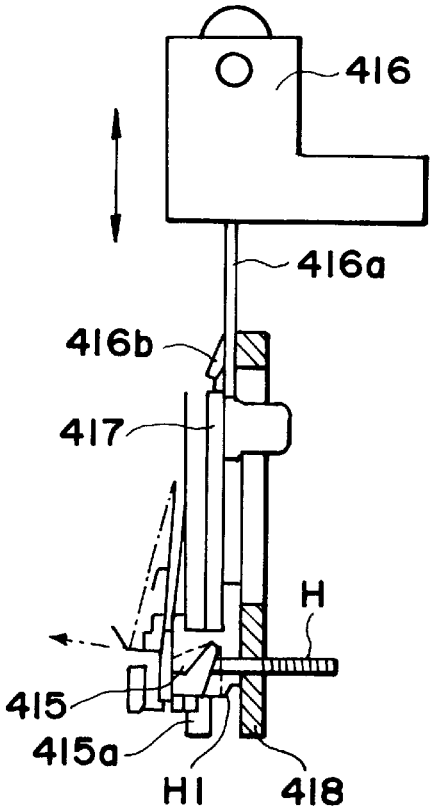
FIG. 14 is a schematic drawing depicting the stapling action of the forming portion of the electric stapler.

Thereafter, the eccentric cam gear 408 is rotated to move the forming portion 401 to the operational position located below. Then, referring to FIG. 14, a driver 416 is pushed down by an unillustrated driving mechanism, whereby a plunger 416*a* is pushed down. As the plunger 416*a* is pushed down, a U-shaped bending block 417 is pushed by a pushing claw 416*b* formed as a part of the plunger 416*a*. As a result, the U-shaped bending block 417 is pressed onto the stapling bending block 415. Consequently, the staple H held in the holding groove 415*a* of the staple bending block 415 is bent into the U-shape as illustrated in FIG. 13.

Next, as the plunger 416*a* is pushed down further, the pushing claw 416*b* is disengaged from the U-shaped bending block 471, and only the plunger 416*a* is pushed down, coming in contact with the tapered portion of the staple bending block 415. As the plunger 416*a* is further pushed downward, it pushes away the staple bending block 415 to the position illustrated by a single dot chain line, and cuts off only the staple H1, which is located at the leading end of the plate of the staples, and has been bent into the U-shape, in coordination with a staple cutting member 418. As the plunger 416*a* is further pushed down, it pushes the staple H1 through the sheet set S, and presses the staple H1 against the stapling table 402. As a result, the sheet set S is bound.

Thereafter, the forming portion 401 is moved to the standby position on the top side by the further rotation of the eccentric cam gear 408. Then, the driver 416 and the plunger 416*a* are moved upward to their standby positions, ending a single cycle of the stapling operation.

Next, the structure of the staple cartridge 403 and a method for loading the cartridge 403 with the staples H will be described.

Figure 15:
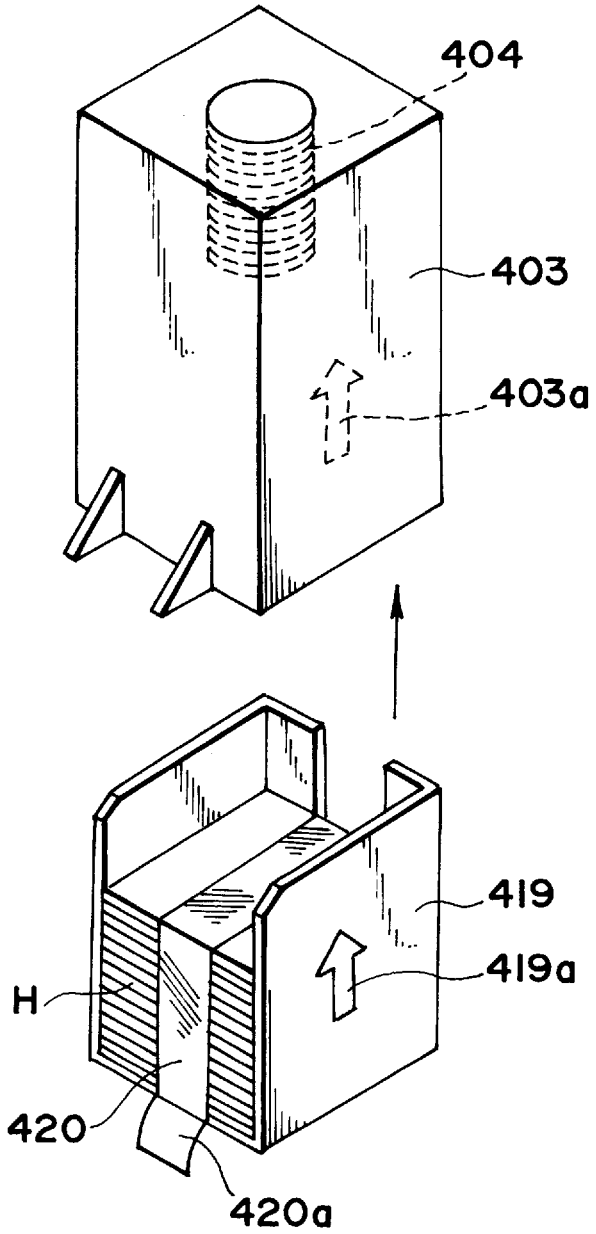
FIG. 15 is a perspective view of a staple cartridge for the electric stapler, and the staples therein.

The staple cartridge 403 is constituted of a box-shaped case with an open bottom. Recently, it has come to be molded of transparent plastic or resin, as a single piece case. Referring to FIG. 15, a spring 404 is affixed to the top surface of the staple cartridge 403 to apply downward pressure to the staples H loaded in the staple cartridge 403. The staples H loaded in the staple cartridge 403 are held therein by a holding means such as a click so that they do not fall out of the bottom opening provided for loading the staples H.

As for the staple H, it is constituted of a rod-like needle. Plural staples H are put together into the form of a plate, and plural plates of staples are loaded in the staple cartridge 403 one upon another. The staple H is available in the form of a pack in which plural plates of the staples H are disposed in layers, being bound by a tape 420 wrapped vertically around the staple layers, and are held from two sides by a U-shaped wrapping paper 419. The tape 420 is provided with a tab 420*a* so that the tape 420 can be easily peeled off by pulling the tab 420*a*.

As for the staple cartridge 403, on one of the lateral walls of the staple cartridge 403, an arrow mark 403*a* indicating the direction in which the staples H must be loaded is printed, or is formed using a method for creating surface wrinkles. Also on one of the lateral surfaces of the wrapping paper 419 holding the layers of staple plate, an arrow mark 419*a* similar to the arrow mark 403*a* is printed to indicate the direction in which the staple must be loaded.

Since the arrow marks 403*a* and 419*a* indicating the staple loading direction are provided on the lateral surfaces of the staple cartridge 403 and wrapping paper 419, respectively, it is possible to avoid loading the staple H in the staple cartridge 403 upside-down or in reverse. Therefore, stapling can be efficiently done.

Figure 16:
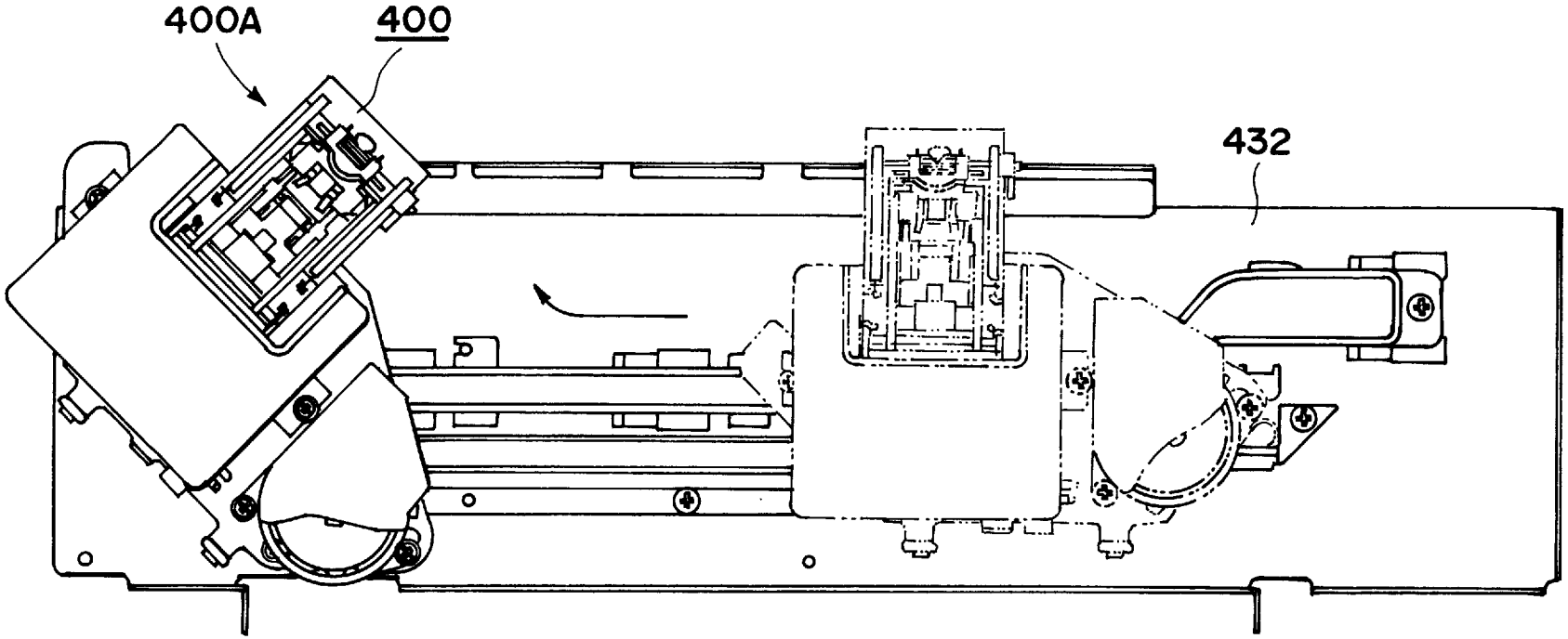
FIG. 16 is a schematic drawing depicting the shifting of the stapler unit position during the staple loading.

When the staple H runs out, the absence of the staple H is detected by the reflection type sensor 409 disposed at the bottom portion of the staple cartridge 403, as described before. As the absence of the staple H is detected, the stapler unit 400A is retained at the home position as illustrated in FIG. 16, and the absence of the staple H is displaced on the display portion employing the LED's or the like.

Figure 17:
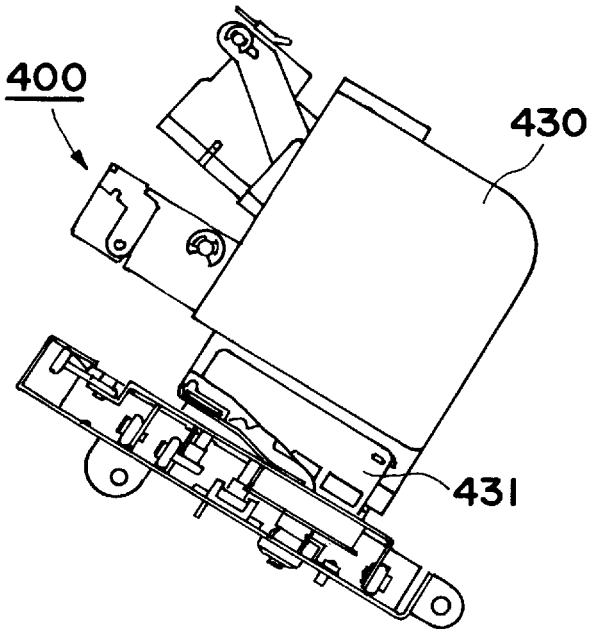
FIG. 17 is a schematic drawing depicting the state of the electric stapler at the moment the staple reloading begins.
Figure 18:
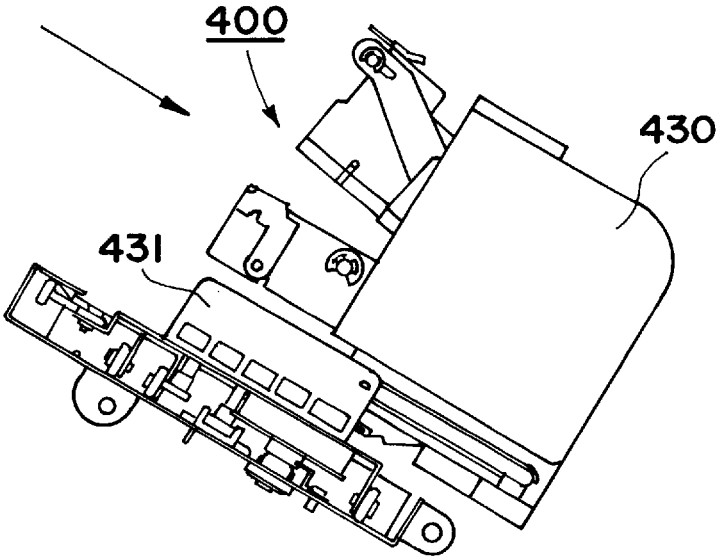
FIG. 18 is a schematic drawing depicting the way the electric stapler is slid along a supporting member.

When the out-of-staple message is displayed, an operator is to slide the electric stapler 400, which is at the home position and is in the state illustrated in FIG. 17, along the supporting member 431 in the direction of an arrow mark in FIG. 18. Then, after the electric stapler 400 reaches the end portion of the supporting member 431, the operator is to rotate the electric stapler 400 in the direction of an arrow mark in FIG. 19, and is lastly to pull out the staple cartridge 403 from the electric stapler 400.

Next, the staplers H held by the wrapping paper 419 must be pressed into the staple cartridge 403 having been pulled out of the electric stapler 400, matching the arrow marks 419*a* and 403*a* as shown in FIG. 15. Thereafter, the tape 420 binding the plates of staple H can be peeled off by pulling the tab 420*a*, ending the loading of the staple H.

Figure 19:
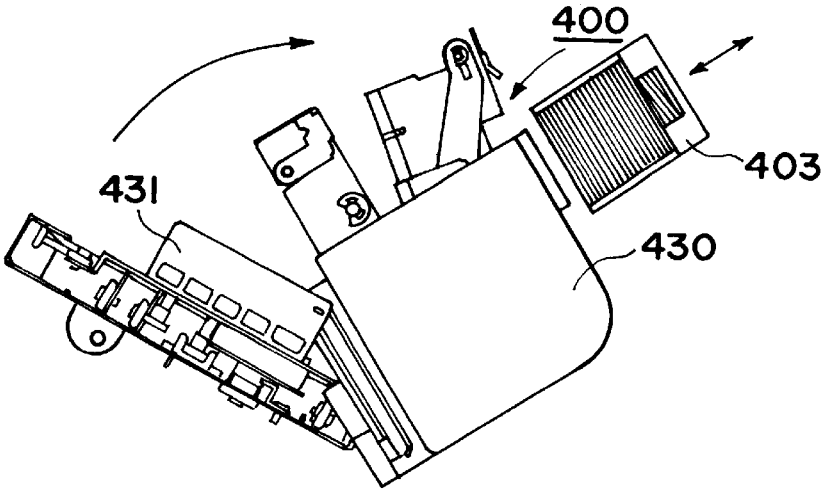
FIG. 19 is a schematic drawing depicting the way the staple cartridge is installed into, or removed from, the electric stapler.

After the staples are loaded into the staple cartridge 403, the cartridge 403 is installed in the electric stapler 400. Then, the electric stapler 400 is rotated in the direction opposite to the direction indicated by the arrow mark in FIG. 19, is slid along the supporting member 431 in the direction opposite to the direction indicated by the arrow mark in FIG. 18, and is lastly returned to the position illustrated in FIG. 17, ending the staple loading operation.

Next, the sheet processing operation of the post-image formation sheet processing apparatus equipped with the stapler unit 400A will be described.

Figure 20:
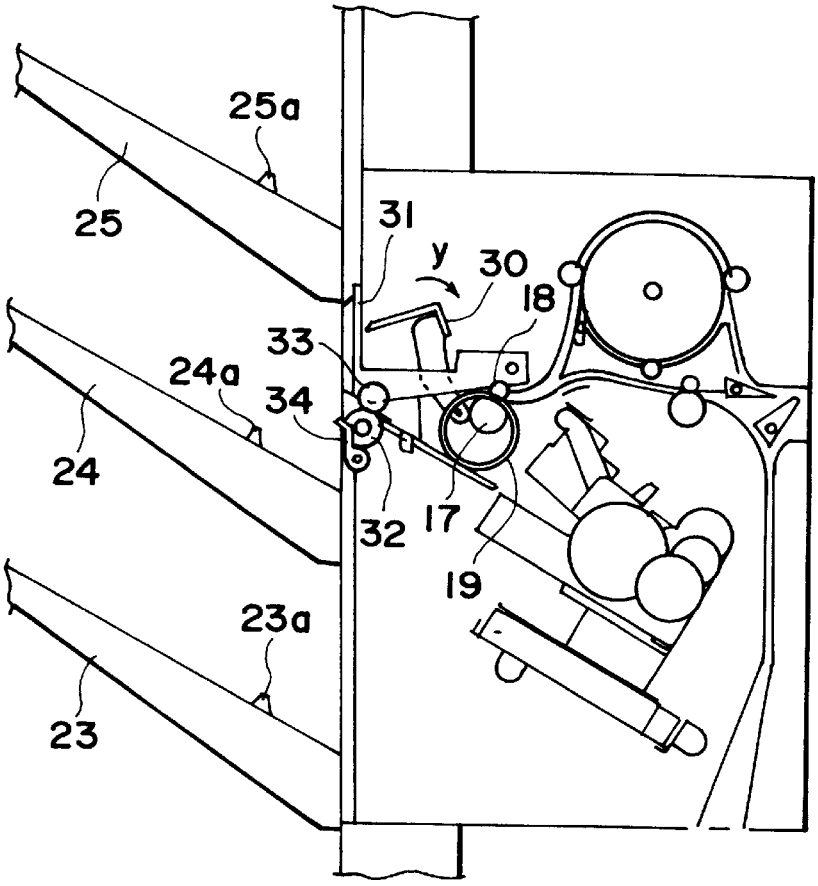
FIG. 20 is a schematic side view showing the state of the post-image formation sheet processing apparatus discharging a sheet into a second tray.

For example, when discharging copy sheets without stapling them, the copy sheets are directly discharged into the first, second and third trays 23, 24 and 25. FIG. 20 illustrates the case in which the copy sheets are discharged into the second tray 24.

Figure 21:
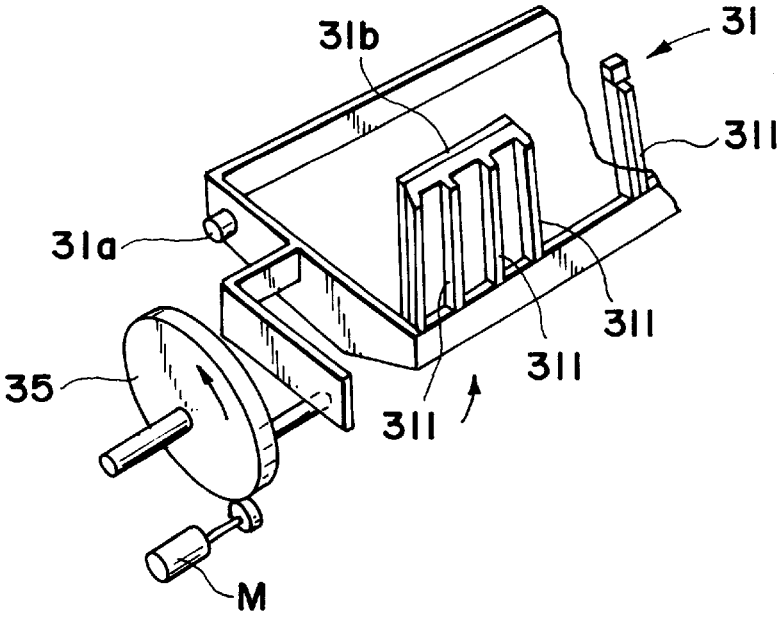
FIG. 21 is a perspective view depicting the way the oscillating guide of the post-image formation sheet processing apparatus oscillates.

As the non-stapling mode is selected by the user, a cam 35 illustrated in FIG. 21 is rotated by a driving power source M in the direction of an arrow mark, whereby an oscillating guide 31 is rotated about an oscillation axis 31*a* to a position at which it makes discharge rollers 32 and 33 contact each other with a predetermined contact pressure. At this time, a stopper 30 for closing a discharge opening 50 is resting at a position to which it has been rotated in the direction opposite to the moving direction of the oscillating guide 31.

The sheets discharged in this state from the copying machine main assembly 100 are passed through the path 6 illustrated in FIG. 2, relayed to the roller pairs 5 and 17, conveyed further downstream, directed toward the tray 24 by the oscillating guide 31, and finally discharged from the discharge opening into the tray 24 by the discharge rollers 32 and 33, accumulating on the tray 24.

When the conditions of the sheet S are not preferable, for example, when the sheet carries electric charge, or when the sheet cannot be discharged with sufficient velocity due to the high coefficient of friction of the sheet S, the trailing end of the sheet S sometimes hangs up at the transfer portion between the roller 32 and a grid board bottom guide 27*a*, failing to be completely discharged.

Figure 22:
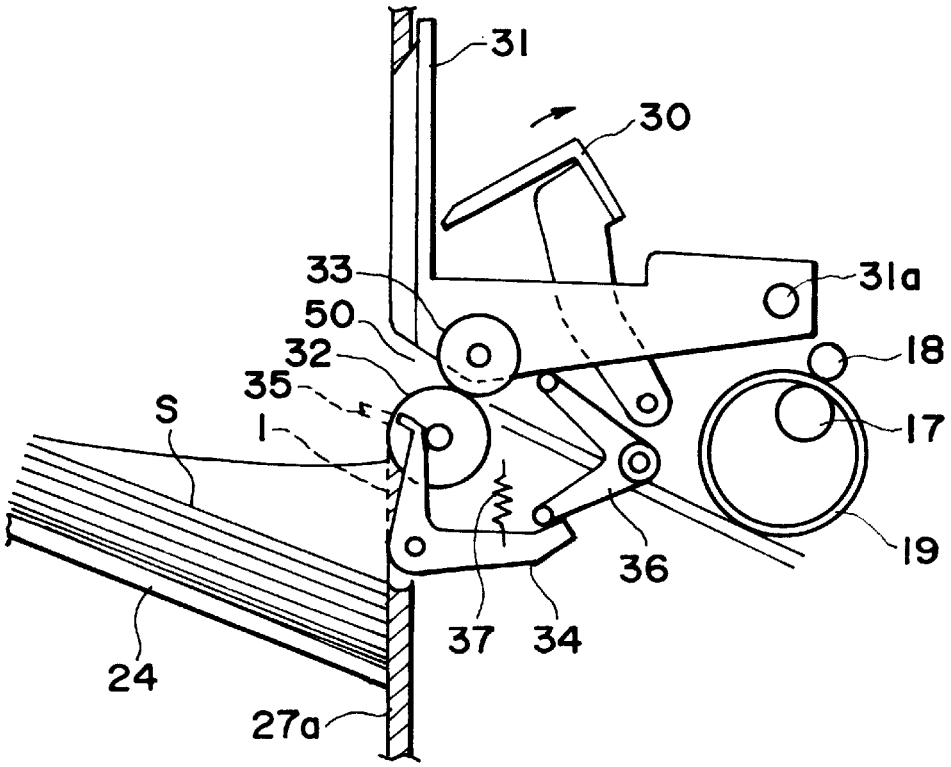
FIG. 22 is a sectional side view depicting the state of the post-image formation sheet processing apparatus discharging a sheet into the second tray.

Therefore, in this embodiment, a roller guide 34 is pivoted in an oscillating manner adjacent to the top end of the grid board bottom guide 27*a*, as shown in FIG. 22, so that an escape portion I is provided for the grid board bottom guide 27 to prevent the sheet S from hanging up.

Figure 23:
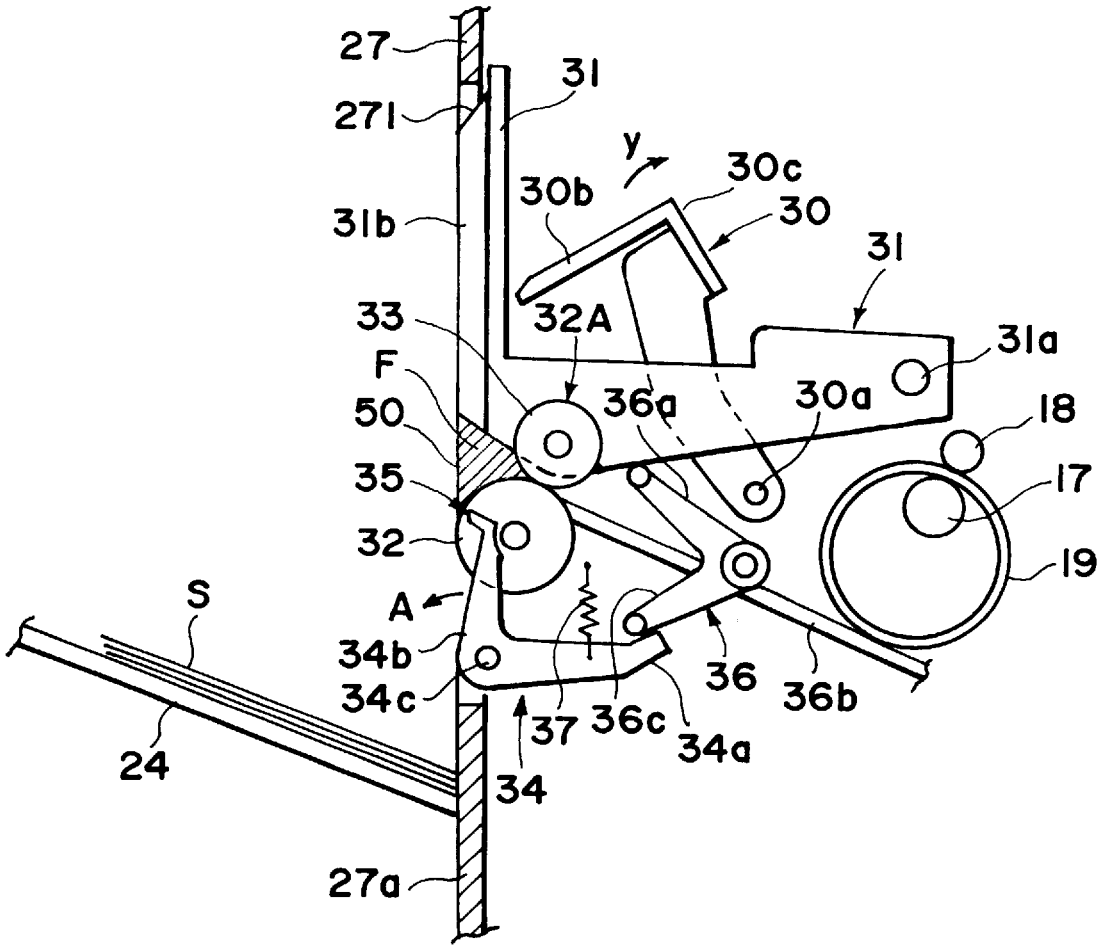
FIG. 23 is a schematic section of the sheet processing apparatus in which the roller guide is disposed at a position for forming an escape for the sheet.

The roller guide 34 is kept under pressure applied by a spring 37 in the direction of an arrow mark A in FIG. 23, and when a sheet is discharged, a link 36 is pushed down by the oscillation of an oscillating guide 31, and the roller guide 34 is rotated by the link 36 in the direction opposite to the arrow A direction to create the escape portion I (FIG. 22). Meanwhile, a sheet stopper portion 35 disposed in a manner to project from the top end portion of the roller guide 34 is retracted in the inward direction of the discharge roller, below the circumference of the discharge roller 32, so that it does not disrupt sheet discharge.

When stapling, as the oscillating guide 31 swings upward to expose the discharge opening 50, the roller guide 34 is pushed back by the spring 37, causing the sheet stopper 35 to project above the tray 24, and the surface of the roller guide 34 becomes even with the surface of the grid board bottom guide 27*a*. Thus, the stapled sheets accumulated in the tray 24 are prevented from slipping into the escape portion I and hanging up therein.

When a large number of regular size sheets are received, it is first confirmed by sheet presence detection sensors 23*a*, 24*a* and 25*a* (FIG. 2) provided on the first, second and third trays 23, 24 and 25 (FIG. 2), correspondingly, that no sheet is remaining in the first, second and third trays 23, 24 and 25, and then, the tray unit 26 is moved to a predetermined position at which it receives the first sheet for the first tray 23.

After the number of the sheets accumulated in the tray unit 26 reaches a predetermined number, the tray unit 26 is lowered to a predetermined level so that the surface level of the uppermost sheet of the sheets accumulated in the tray unit 26 becomes substantially even with the level at which the first sheet for the first tray 23 was received. This top surface level adjustment cycle is repeated until a maximum number of the sheets have been accumulated in the tray. As soon as it is detected that the accumulation limit has been reached, a stop signal is sent to the copying apparatus main assembly 100 to temporarily stop the sheet discharge.

Next, in order to allow the sheets to be accumulated in the second tray 24 of the tray unit 26, the tray unit 26 is lowered to a predetermined level at which the first sheet for the second tray 24 is received. Then, the copying apparatus main assembly 100 is allowed to restart the copying operation, and the sheet accumulation begins. Thereafter, the same top surface level adjustment cycle as described above is repeated until the tray 24 is completely filled. The operational shift from the second tray 24 to the third tray 25 to accumulate sheets in the third tray 25 is the same as the operational shift from the first tray 23 to the second tray 24.

In this embodiment, the copying apparatus main assembly 100 is of a digital type, which comprises a scanner section for reading the image of an original, and a printing section for reproducing the original. The two sections can be independently operated. In the scanner section, the original is illuminated with a lamp, and the light reflected from the original is focused, as an optical image of the original, on a light receptor element, which converts the optical image into electric signals (photoelectric transfer) correspondent to the reflective light distribution of the original, by means of breaking up the optical image into small dots (picture elements). In the printer section, an electrostatic latent image is formed on a drum by means of scanning the drum with a laser beam modulated with the electric signals sent from the scanner section, and the latent image is developed, transferred, and fixed, to produce a copy image.

Therefore, by connecting an interface 500 to the digital copying machine as illustrated in FIG. 1, the signals obtained by reading the original in the scanner section can be transferred to a facsimile 501 other than the printer section, or electric signals received from the facsimile 501 can be fed to the printer section through the interface 500 to produce an image on a transfer sheet. Also, it is possible to feed image signals received from a computer 502 such as a personal computer to the printing section through the interface 500 to produce an image on a transfer sheet, or to input image data obtained by reading an image in the scanner section, into a personal computer.

As described above, not only can the latest digital copying machine copy an original sent from the ADF 300, or an original placed on the original placement glass plate 100, but also it can be used as a facsimile or a printer for a personal computer, with the provision of the interface 500.

However, in order to use the main assembly 100 for the aforementioned purposes, it is necessary to sort various sheets into separate trays, and also, sometimes, it is necessary to sort various sheets into the numbered trays specified by the user.

In this embodiment, therefore, an arrangement is made so that the facsimile output sheet is discharged into the first tray 23; the personal computer output sheet is discharged into the second tray 24; and the copy mode output sheet is discharged into the third tray 25, for example. Next, such an arrangement will be described.

Figure 24:
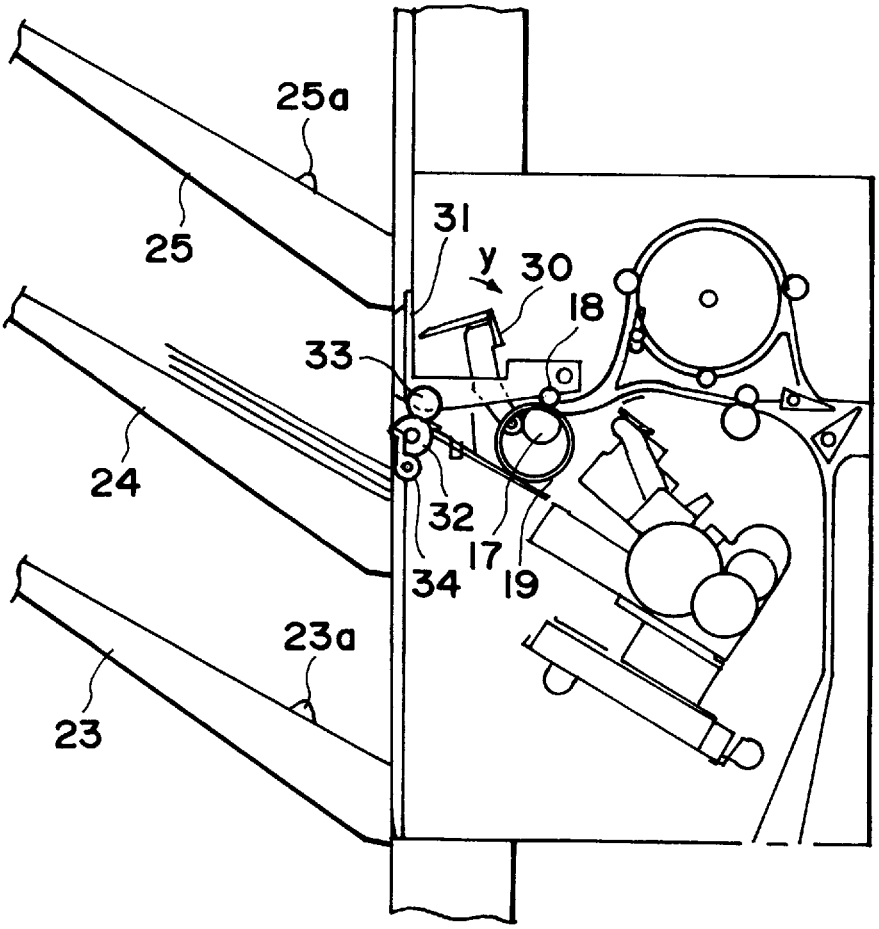
FIG. 24 is a sectional side view depicting the way the sheets outputted in response to the command from a personal computer are accumulated in the second tray.

First, referring to FIG. 24, a case in which the copy mode output sheet is accumulated after a certain number of personal computer output sheets are received in the second tray 24, that is, a case in which sheets are accumulated in the third tray 25, will be described.

In case sheets are accumulated in the third tray 25 after a certain number of the personal computer output sheets are received in the second tray 24, the tray unit 26 is lowered so that the third tray 25 is moved to the position at which the third tray 25 receives the first sheet for the third tray 25. This shifting of the tray position is the same as the top surface level adjustment cycle for the copy mode, except that the tray unit is lowered even though the number of the sheets in the tray has not reached the maximum.

Next, a case in which the output sheets from a facsimile machine or the like are accumulated after a certain number of the personal computer output sheets have been received in the second tray 24, that is, a case in which the sheets are accumulated in the first tray 23, will be described.

Figure 25:
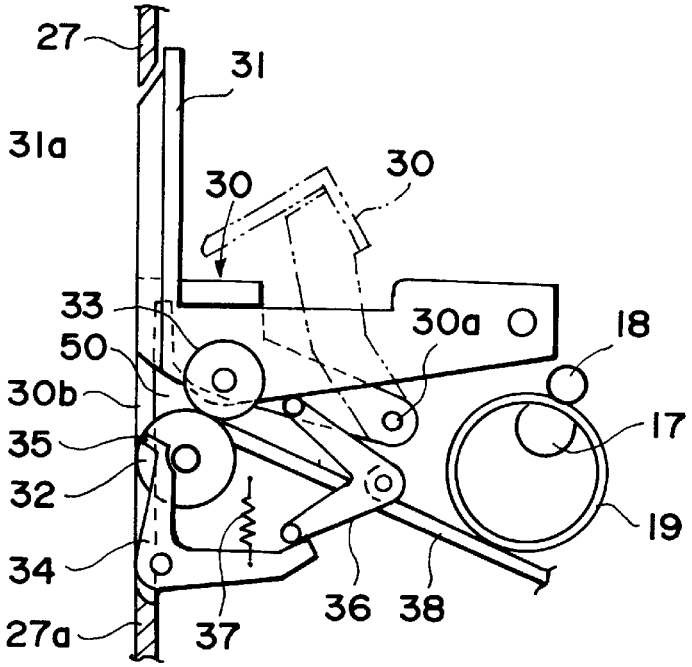
FIG. 25 is a schematic drawing depicting the state of the post-image formation sheet processing apparatus in which a discharge opening is blocked by the stopper of the sheet processing apparatus.

In this case, in order to allow the sheets to be accumulated in the first tray 23 with the sheets remaining in the second tray 24, the tray unit 26 is raised. Referring to FIG. 25, in order to prevent the sheet S from entering a space F, a diagonally hatched portion in FIG. 23, the stopper 30 is rotated about the rotational axis 30*a* from the position illustrated by a broken line to the position illustrated by a solid line, so that the space F is covered. As a result, it becomes possible to move the tray 24 upward leaving the sheet S within the tray 24.

In other words, the tray carrying the sheet S is allowed to cross the discharge opening 40; therefore, the capabilities of the copying apparatus main assembly 100 with the interface can be fully utilized.

The surface 30*b* of the stopper 30, against which the sheet S abuts, and the top and bottom grid board guides 27 and 27*a*, are provided with ribs 311 like the ribs provided on the surface 31*b* of the oscillating guide 31, against which the sheet S abuts (FIG. 21), so that the sheet S can easily slide thereon. Further, the surface 31*b* of the oscillation guide 31 can be utilized as a part of the grid board top guide 27 to reduce the tray interval. Therefore, the tray unit 26 can be downsized.

Next, the stapling operation of the post-image formation sheet processing apparatus will be described.

First, when in the stapling-sorting mode for stapling copies, sheets are not directly accumulated in the trays 23, 24 and 25; sheets are accumulated in the stapling tray 38 illustrated in FIG. 2.

Figure 26:
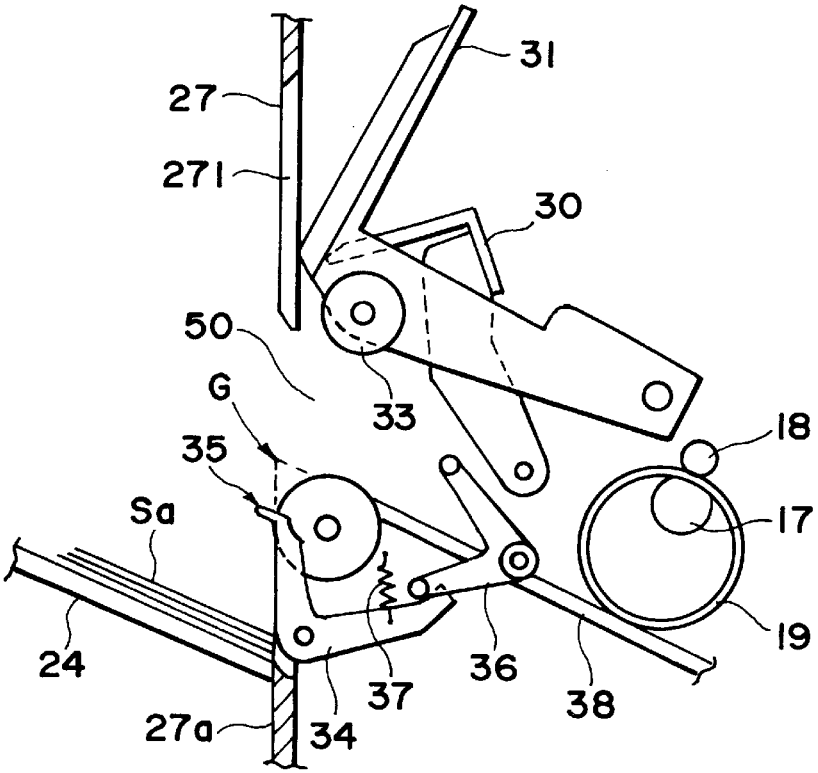
FIG. 26 is a schematic drawing depicting a state of the post-image formation sheet processing apparatus in which the oscillating guide has been rotated upward.

As the stapling-sorting mode is selected by the user, the oscillating guide 31 swings upward to expose the discharge opening as shown in FIG. 26, and at the same time, to separate the discharge rollers 32 and 33. As the oscillating guide 31 rotates in this manner, the roller guide 34 is rotated by the spring 37 so that the surface of the roller guide 34 becomes even with the surface of the grid board bottom guide portion, and the sheet stopper portion 35 projects into the space above the sheet set Sa accumulated in the tray 24.

In this condition, the sheet discharged from the copying apparatus main assembly 100 is meant to be passed through the path 6, and be relayed to the roller pairs 17 and 18 to be discharged by these rollers, but since the oscillating guide 35 has swung up, the sheet is instead accumulated in the stapling tray 38. Meanwhile, the tray 24 remains above the level at which it remains in the non-stapling mode, and supports the trailing end of the sheet S to help the sheet S return upstream relative to the discharge direction.

Figure 27:
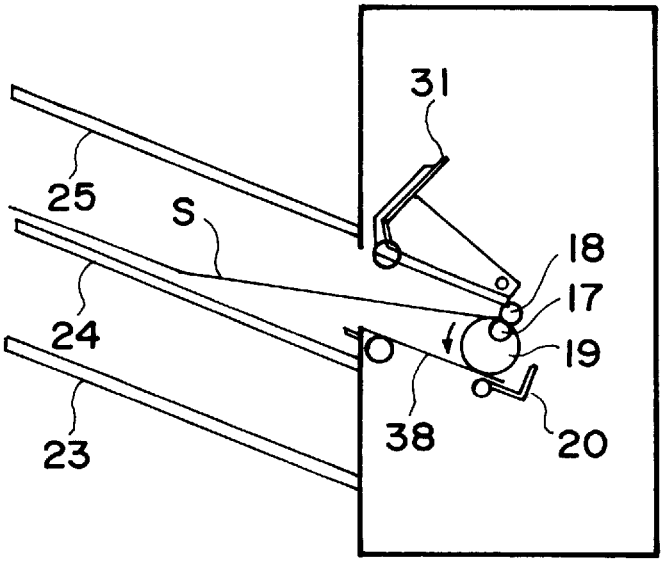
FIG. 27 is a schematic side section depicting the state of the second tray in a stapling-sorting mode.

Also referring to FIG. 27, the sheet S discharged onto the stapling tray 38 slides down in the upstream direction, relative to the discharge direction, due to its own weight and the angle of the stapling tray 38, and also, because the falling point of the sheet in the tray 24 is raised. Further, pressure is applied to the sheet S in the upstream direction, by the discharge alignment belt 19 rotating in the arrow direction in synchronism with the discharge roller 17.

Figure 28:
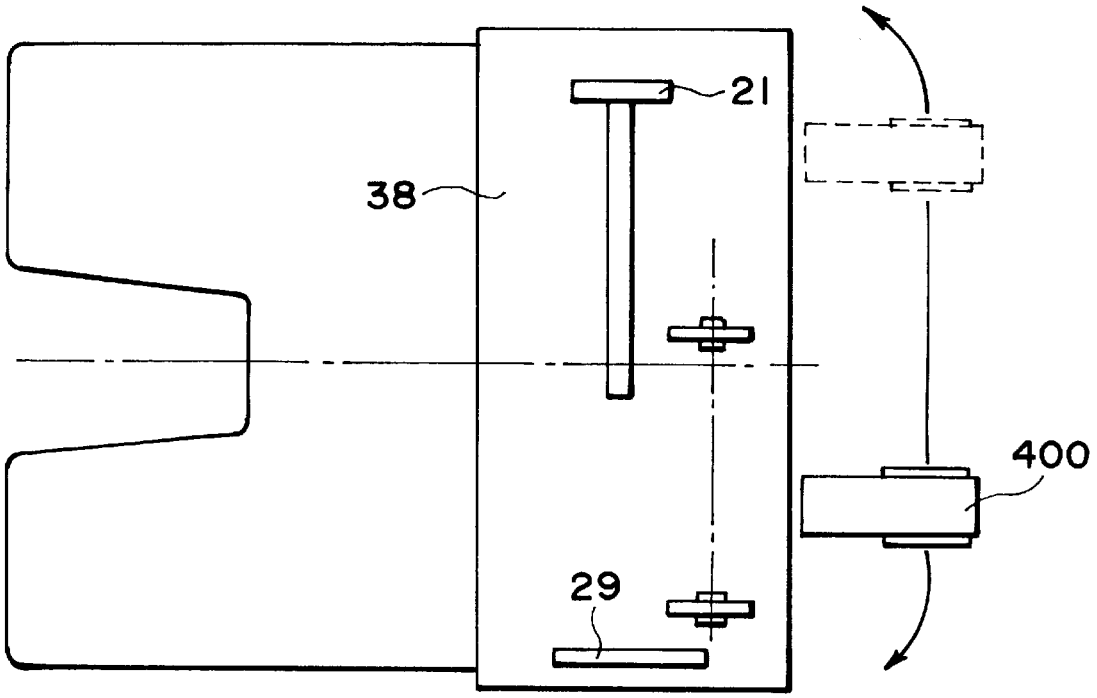
FIG. 28 is a plan view of the staple tray portion of the post-image formation sheet processing apparatus.
Figure 29:
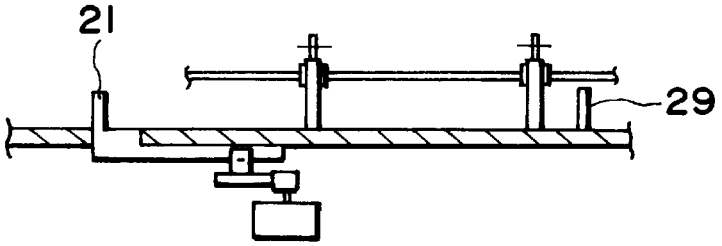
FIG. 29 is a sectional side view of the stapling tray portion.

With the provision of the above arrangement, the sheet S becomes aligned in the direction perpendicular to the discharge direction as it butts the trailing end regulating member 20. As for the alignment in the width direction of the sheet S, the lateral jogging plate 21 is responsible. It begins to jog the sheet S in the rear to front direction against an alignment reference plate 29 illustrated in FIGS. 28 and 29, at the time when the sheet S having fallen onto the stapling tray 38 butts the trailing end regulating member 20. As a result, the sheet S is aligned at the front edge. This sheet aligning cycle is repeated for the rest of the sheets until the sheets are accumulated on the stapling tray by the number set by the user.

Figure 30:
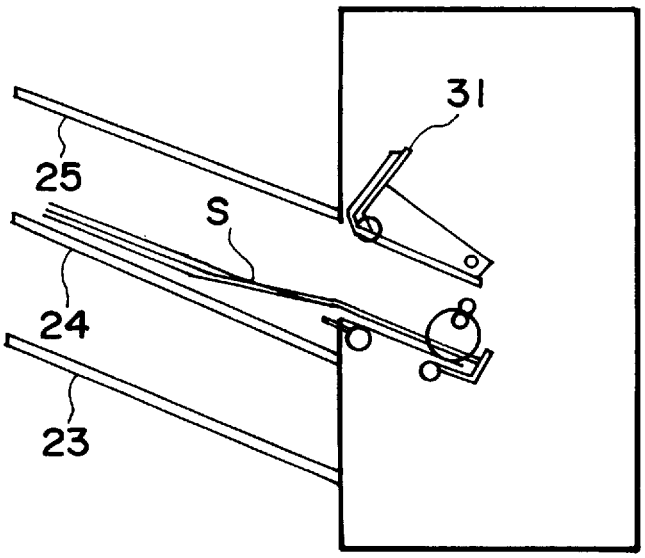
FIG. 30 is a schematic drawing depicting the manner in which multiple sheets, whose number is set by the user, have been aligned on the staple tray.
Figure 31:
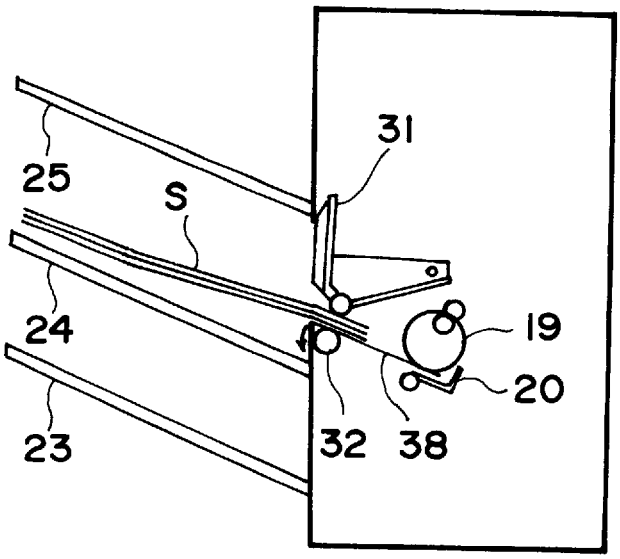
FIG. 31 is a schematic drawing depicting the manner in which the stapled sheets are being discharged.
Figure 32:
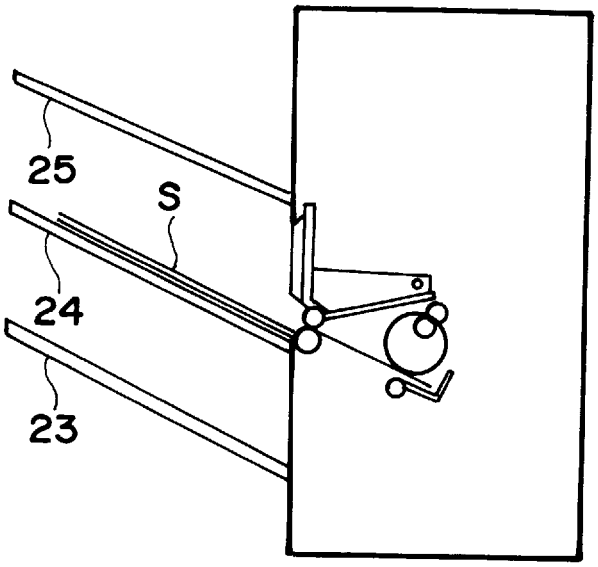
FIG. 32 is a schematic drawing depicting the manner in which the stapled sheets have been discharged.

After the sheets, the number of which is set by the user, are aligned on the stapling tray 38 as shown in FIG. 30, the stapler staples the sheets on the point selected by the user. After stapling, the oscillating guide 31 is lowered and then is rotated in the direction of an arrow mark as shown in FIG. 31, whereby the stapled set of sheets S on the stapling tray 38 is discharged.

However, since the sheets are sequentially discharged from the copying apparatus main assembly 100 even while the stapler is in action, the first sheet for the next job is held up in the copying apparatus main assembly 100 to wait for the second sheet, and then is discharged together with the second sheet placed on top of the first sheet.

Figure 33:
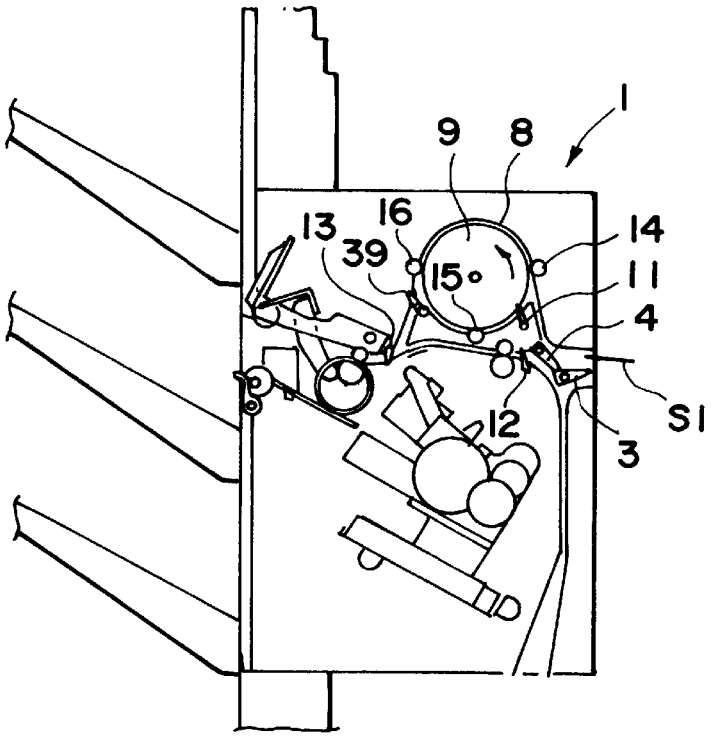
FIG. 33 is a schematic drawing depicting the state of the post-image formation sheet processing apparatus immediately after the sheet began to enter it.

This operation will be described with reference to FIGS. 33–36. FIG. 33 illustrates the state of the sheet processing apparatus, in which the sheet S1 has begun to enter the copying apparatus main assembly 100.

Figure 34:
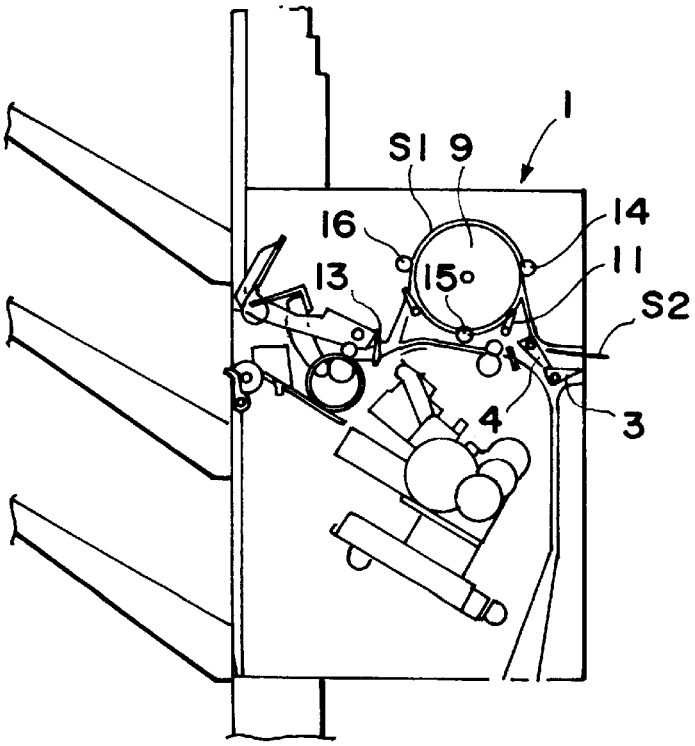
FIG. 34 is a schematic drawing depicting the state of the post-image formation sheet processing apparatus, in which the first sheet has been wrapped around the buffer roller.

The first sheet S1 discharged from the copying apparatus main assembly 100 is sent to the buffer path 8 by directing the upstream side portions of the flappers 3 and 4 downward. Entering the buffer path 8, the sheet S1 is conveyed in the direction of an arrow mark in a manner to wrap itself around the buffer roller 9. As the leading end of the sheet S1 is detected by the sensor 11, a flapper 39 is rotated to the position for guiding the sheet S1 toward a roller 15, and is kept there as shown in FIG. 34.

Figure 35:
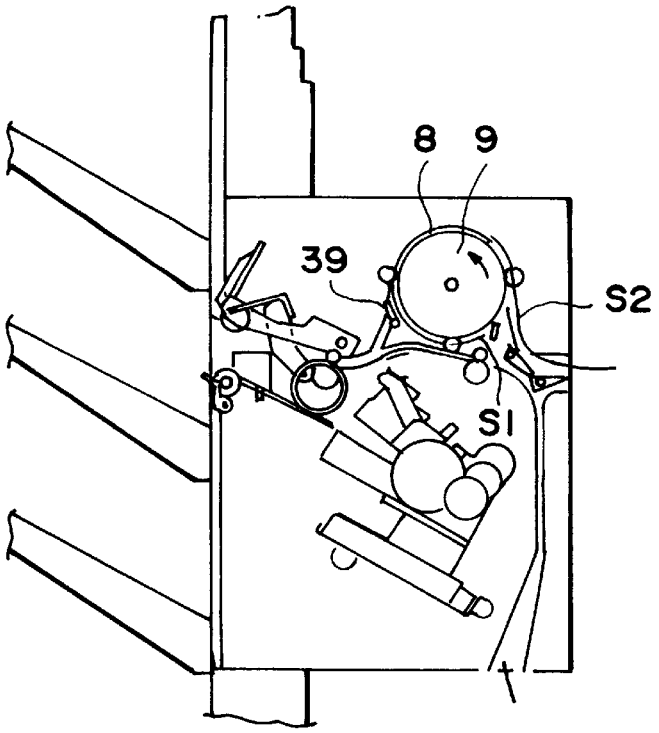
FIG. 35 is a schematic drawing depicting the state of the post-image formation sheet processing apparatus, in which the first and second sheets S1 and S2 are being conveyed together, one upon the other.
Figure 36:
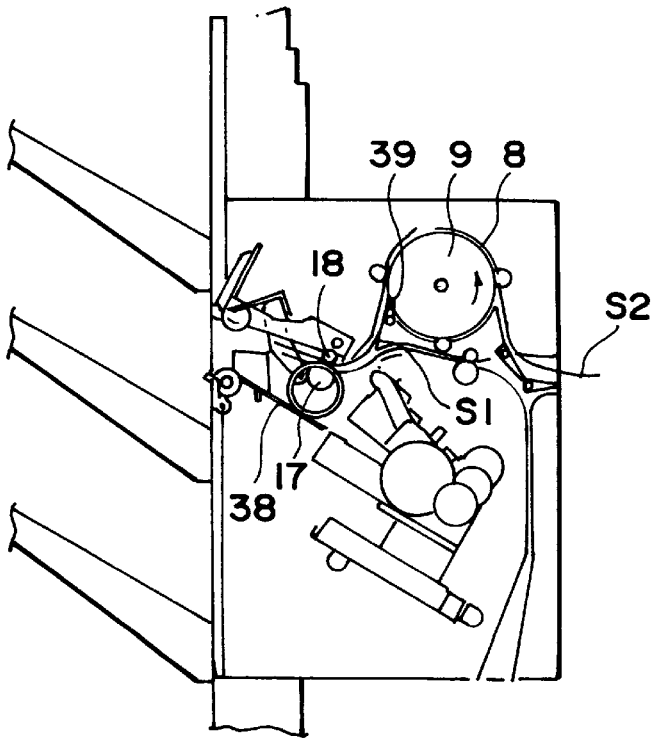
FIG. 36 is a schematic drawing of the state of the post-image formation sheet processing apparatus, in which the two sheets are being discharged together, one upon the other.

Next, as the second sheet S2 enters the sheet processing apparatus as shown in the same drawing, the buffer roller 9 begins its rotation, conveying both the first and second sheets S1 and S2 one upon the other as shown in FIG. 35. Then, as the trailing end of the first sheet S1 passes the position of the flapper 39, the flapper 39 is rotated in the direction to guide the sheet S toward the discharge rollers 17 and 18 as shown in FIG. 36. As a result, the first and second sheets S1 and S2, one being on the other, are discharged together onto the stapling tray 38. With the provision of the above operational arrangement, the sheet is not discharged from the discharge rollers 17 and 18 while the stapler is in action; therefore, stapling can be done without stopping the copying apparatus main assembly 100.

It is possible to wrap three or more sheets around the buffer roller 9 to earn more time for the stapling operation.

Plural stapled sets of copies Sa are produced by repeating the above described operations. When there are stapled sets of copies Sa on the tray 24 as shown in FIG. 26, the top end of the accumulated sets of copies Sa may sometimes project above a G point due to excessive flex or swelling of the stapled sets of copies Sa. Such an occurrence may cause the next sheet to hang up as it is discharged, and therefore, may cause a paper jam. Further, it may interfere with the lateral jogging action by the lateral jogging guide 21, and therefore, may result in poor sheet alignment.

However, in this embodiment, the roller guide 34 is positioned in such a manner that the surface of the roller guide 34 becomes even with the surface of the grid board bottom guide 27*a,* and also, the stopper member 35 projects into the space above the tray 24 in a manner to press down the top end of the accumulated sets of copies Sa; therefore, the top end of the accumulated sets of copies Sa does not project above the point G.

Figure 37A:
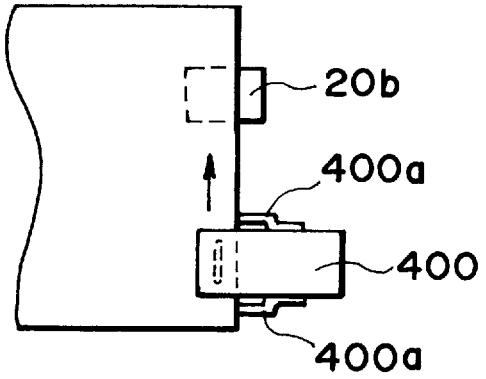
FIGS. 37(*a*) and 37(*b*) are a plan view of the stapler and the adjacencies thereof in another embodiment of the present invention.
Figure 37B:
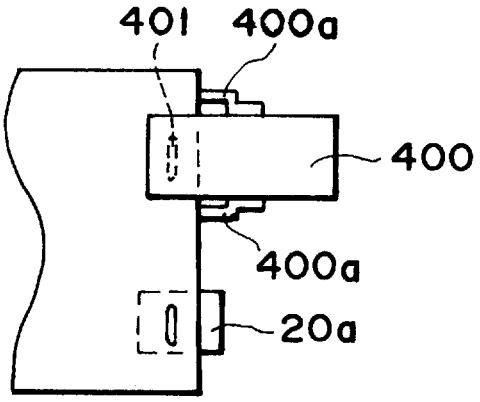
Figure 38:
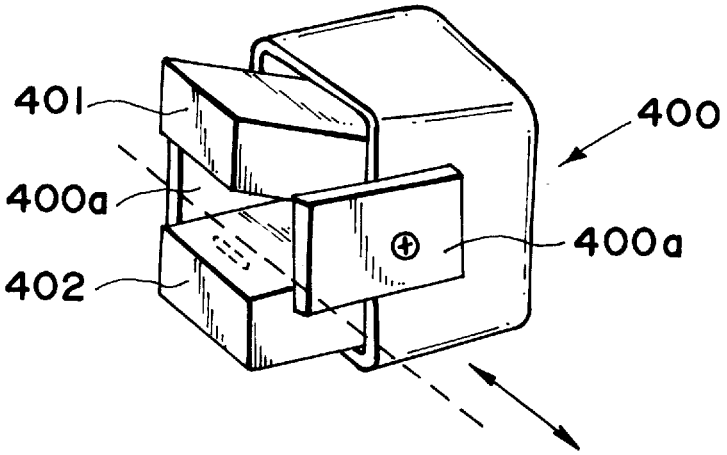
FIG. 38 is a perspective view of the stapler illustrated in FIG. 37.

Next, referring to FIGS. 37(*a*), 37(*b*) and 38, another embodiment will be described.

This embodiment in characterized in that the stapler 400 is provided with a stationary regulating member 400*a*. The stationary regulating member 400*a* may be integrally formed or may be screwed to the stapler 400. It aligns the edges of the sheets entered between the head 401 and the anvil 402. Therefore, it can align a set of sheets in place of the retracted regulating member 20*a* as shown in FIG. 37(*b*).

While the invention has been described with reference to the structures disclosed herein, it is not confined to the details set forth, and this application is intended to cover such modifications or changes as may come within the purposes of the improvements or the scope of the following claims.

What is claimed is:

1. A sheet post processing apparatus comprising:

a tray for stacking a set of sheet;

post processing means for post processing the set of sheets on said tray, wherein when said post processing means processes the sheets, said post processing means is moved to a predetermined position corresponding to a processing position for the set of sheets;

a regulating member movably mounted for aligning the sheets stacked on said tray by abutting such edges of the sheets where the sheets are processed;

retracting means for retracting said regulating member to a position not obstructing movement of said post processing means, when said post processing means is moved.

2. An apparatus according to claim 1, wherein a plurality of such said regulating members are provided arranged in a movement direction of said post processing means, and they are independently movable in interrelation with movement of said post processing means.

3. An apparatus according to claim 1, wherein said retracing means is pushed by said post processing means to rotate said regulating means to below said tray.

4. An apparatus according to claim 1, wherein said tray is inclined upwardly toward downstream with respect to sheet discharging direction, and wherein said regulating means is disposed at an upstream position, and the discharged sheets are switched back and are abutted to said regulating means.

5. An apparatus according to claim 4, wherein said post processing means moves in a direction crossing with the sheet discharging direction to change the processing position.

6. An apparatus according to claim 5, wherein said post processing means includes a stapler which opens in a clam fashion to receive the set of sheets and staples it.

7. An apparatus according to claim 3, wherein said retracting means comprises a swingable lever swinging in interrelation with movement of said post processing means, and converting means for converting its swinging motion to rotational motion.

8. An apparatus according to claim 7, wherein said swingable lever is a sector gear, and said converting means includes a rotatable gear meshed therewith.

9. An apparatus according to claim 2, wherein said regulating means located opposed to said post processing means is in the retracting means, and the rest of the regulating means is in a sheet aligning position.

10. An apparatus according to claim 2, further comprising a spring for restoring said regulating means after passage of said post processing means.

11. An apparatus according to claim 1, wherein said post processing means includes a stapling head and an anvil arranged in a clam fashion, and further includes a stopper for being abutted to by the sheets entering between said stapling head and said anvil.

* * * * *